US008950890B2

(12) United States Patent
Seki et al.

(10) Patent No.: US 8,950,890 B2
(45) Date of Patent: Feb. 10, 2015

(54) LAMP AND LIGHTING APPARATUS

(75) Inventors: Katsushi Seki, Shiga (JP); Toshifumi Ogata, Osaka (JP); Makoto Morikawa, Nara (JP); Shinichi Kitaoka, Osaka (JP); Kenji Maruyama, Osaka (JP)

(73) Assignee: Panasonic Intellectual Property Management Co., Ltd., Osaka (JP)

( * ) Notice: Subject to any disclaimer, the term of this patent is extended or adjusted under 35 U.S.C. 154(b) by 76 days.

(21) Appl. No.: 13/822,804

(22) PCT Filed: Oct. 19, 2011

(86) PCT No.: PCT/JP2011/005864
§ 371 (c)(1),
(2), (4) Date: Mar. 13, 2013

(87) PCT Pub. No.: WO2012/053204
PCT Pub. Date: Apr. 26, 2012

(65) Prior Publication Data

US 2013/0182425 A1 Jul. 18, 2013

(30) Foreign Application Priority Data

Oct. 22, 2010 (JP) ..... 2010-237853

(51) Int. Cl.
*F21V 11/00* (2006.01)
*F21K 99/00* (2010.01)
*F21V 23/00* (2006.01)
(Continued)

(52) U.S. Cl.
CPC . *F21V 11/00* (2013.01); *F21K 9/17* (2013.01); *F21V 23/002* (2013.01); *F21V 7/00* (2013.01); *F21Y 2101/02* (2013.01); *F21Y 2103/003* (2013.01); *F21V 7/005* (2013.01)
USPC ..... 362/217.05

(58) Field of Classification Search
CPC ..... F21V 11/00; F21V 7/00; F21V 7/005; F21V 23/002; F21V 15/013; F21V 21/00; F21K 9/00; F21K 9/17; F21Y 2103/00; F21Y 2103/003; F21S 4/003; F21S 4/008
See application file for complete search history.

(56) References Cited

U.S. PATENT DOCUMENTS 7,618,157 B1 * 11/2009 Galvez et al. ..... 362/294
8,220,976 B2 * 7/2012 Liu et al. ..... 362/373
(Continued)

FOREIGN PATENT DOCUMENTS

JP 1-276505 11/1989
JP 2009-43447 2/2009
(Continued)

OTHER PUBLICATIONS

China Office action, dated Aug. 22, 2014 along with search report an english translation thereof.

*Primary Examiner* — Bao Q Truong
(74) *Attorney, Agent, or Firm* — Greenblum & Bernstein P.L.C.

(57) ABSTRACT

A lamp according to the present invention includes: a line portion which blocks a part of light proceeding from a light emitting unit in a direction perpendicular to a tube axis direction; and a raised portion which blocks the light proceeding from the light emitting unit in the direction perpendicular to the tube axis direction that is not blocked by the line portion. The raised portion has an end portion having a linear shape in the tube axis direction, the end portion being an end portion of a section of the raised portion that blocks light.

18 Claims, 21 Drawing Sheets

(51) Int. Cl.

| | |
|---|---|
| ***F21V 7/00*** | (2006.01) |
| *F21Y 101/02* | (2006.01) |
| *F21Y 103/00* | (2006.01) |

(56) References Cited

U.S. PATENT DOCUMENTS

| | | | | |
|---|---|---|---|---|
| 8,360,599 | B2 * | 1/2013 | Ivey et al. | 362/218 |
| 2009/0219713 | A1 * | 9/2009 | Siemiet et al. | 362/218 |
| 2010/0171405 | A1 * | 7/2010 | Chan et al. | 313/46 |
| 2011/0073883 | A1 | 3/2011 | Osawa et al. | |
| 2011/0103053 | A1 * | 5/2011 | Chen et al. | 362/235 |
| 2012/0201023 | A1 * | 8/2012 | Yoneda | 362/218 |

FOREIGN PATENT DOCUMENTS

| | | |
|---|---|---|
| JP | 2010-40502 | 2/2010 |
| JP | 2010/129382 | 6/2010 |
| JP | 2011-100707 | 5/2011 |
| WO | 03/004930 | 1/2003 |
| WO | 2009/133615 | 11/2009 |
| WO | 2009/145247 | 12/2009 |

* cited by examiner

LAMP AND LIGHTING APPARATUS

TECHNICAL FIELD

The present invention relates to a lamp and a lighting apparatus using a straight tube.

BACKGROUND ART

In recent years, semiconductor light emitting elements such as light emitting diodes (LEDs) are being used in various lamps as highly-efficient space-saving light sources.

An LED lamp using such an LED includes an LED module (light emitting module) which is constructed by sealing an LED mounted on a substrate with resin. While LED lamps include LED lamps shaped in a straight tube (straight tube LED lamps) and fluorescent lamps shaped in a light bulb (light bulb-type LED lamps), both lamps use an LED module which is constructed by arranging a plurality of LEDs on a substrate. For example, Patent Literature 1 discloses a conventional straight tube LED lamp.

CITATION LIST

Patent Literature

[PTL 1]
Japanese Unexamined Patent Application Publication No. 2009-43447

SUMMARY OF INVENTION

Technical Problem

With a straight tube LED lamp, an internally arranged LED module is long in a longitudinal direction or, in other words, a substrate is long in the longitudinal direction. Accordingly, the substrate of the LED module is fragile and the LED module is therefore susceptible to damage.

Accordingly, a conceivable straight tube LED lamp (hereinafter, referred to as a straight tube LED lamp A) is configured such that a plurality of LED modules is arranged lined up in a tube axis direction of a straight tube. In this case, two light emitting modules adjacent to each other must be electrically connected by lines or the like. In other words, in the straight tube LED lamp A, a plurality of lines is lined up in the tube axis direction at predetermined intervals.

In this case, in the straight tube LED lamp A, a part of light emitted by an LED which proceeds in a direction perpendicular to the tube axis direction is blocked by the plurality of lines described above. As a result, shadows of the plurality of lines are projected onto an inner surface of the straight tube of the straight tube LED lamp A. In other words, unappealing shadows are created in the straight tube LED lamp A when light is being emitted by the straight tube LED lamp A.

The present invention has been made in order to solve the problem described above and an object of the present invention is to provide a lamp and a lighting apparatus which are capable of preventing unappealing shadows from being created.

Solution to Problem

In order to solve the above-mentioned problem, a lamp according to an aspect of the present invention includes: a straight tube; a light emitting unit disposed in the straight tube and extending in a tube axis direction; a first light blocking unit configured to block a part of light proceeding from the light emitting unit in a direction perpendicular to the tube axis direction; and a second light blocking unit configured to block the light proceeding from the light emitting unit in the direction perpendicular to the tube axis direction that is not blocked by the first light blocking unit, wherein the second light blocking unit has an end portion having a linear shape in the tube axis direction, the end portion being an end portion of a section of the second light blocking unit that blocks light.

In other words, the lamp includes a first light blocking unit which blocks a part of light proceeding in a direction perpendicular to the tube axis direction from the light emitting unit and a second light blocking unit which blocks light not blocked by the first light blocking unit among light proceeding in a direction perpendicular to the tube axis direction from the light emitting unit. In the second light blocking unit, a shape of an end portion of a section where the second light blocking unit blocks light is a linear shape in the tube axis direction.

Now, let us assume that a shape, in the tube axis direction, of an end portion of a section where the first light blocking unit blocks light is a shape with a raised portion. In this case, a shadow created when the first light blocking unit blocks light is an unappealing shadow.

According to the present aspect, the second light blocking unit blocks light which is not blocked by the first light blocking unit. Therefore, a shadow created when the second light blocking unit blocks light covers the shadow created when the first light blocking unit blocks light. Note that the shape, in the tube axis direction, of an end portion of the section where the second light blocking unit blocks light is a linear shape.

With this configuration, it is possible to prevent unappealing shadows from being created.

In addition, it is preferable that the lamp further include a mount disposed in the straight tube and extending in the tube axis direction.

In addition, it is preferable that: the mount have a recessed portion which extends in the tube axis direction; the lamp further include a substrate which is disposed on a bottom surface of the recessed portion of the mount and has an elongated shape extending in the tube axis direction; and the light emitting unit be disposed on a main surface of the substrate to extend in the tube axis direction.

In addition, it is preferable that the second light blocking unit be a part of the mount.

In addition, it is preferable that: the second light blocking unit include a part of the mount and a fixing portion disposed to cover an upper portion of the part of the mount; and the fixing portion be in contact with the main surface of the substrate to fix the substrate to the mount.

Accordingly, the substrate can be fixed to the mount.

In addition, it is preferable that a height from the bottom surface to an upper end of the second light blocking unit be greater than a thickness of the substrate.

In addition, it is preferable that: the lamp further include a plurality of the substrates and a plurality of the light emitting units; the substrates be arranged adjacent to one another in the tube axis direction; the light emitting units be disposed on the main surfaces of their respective substrates to be adjacent to one another in the tube axis direction; and an electric member be disposed in a vicinity of a boundary between adjacent ones of the light emitting units, the electric member electrically connecting the adjacent ones of the light emitting units.

In addition, it is preferable that the first light blocking unit include one or more of the electric members arranged in the tube axis direction.

In addition, it is preferable that: the straight tube be a glass tube; and the first light blocking unit include the one or more of the electric members and a resin which covers an upper portion of each of the electric members.

In addition, it is preferable that: the first light blocking unit be disposed on the main surface of the substrates adjacent to one another in the tube axis direction; and a height from the bottom surface to an upper end of the second light blocking unit be greater than a height from the bottom surface to an upper end of the first light blocking unit.

In addition, it is preferable that $\alpha$ and $\beta$ be defined by a relational equation of $\alpha>\beta$ when: a line connecting (i) a light emission central position which is a center position of a section from which the light emitting unit emits light and (ii) an upper end of the section of the second light blocking unit that blocks light from the light emitting unit is a first line; an angle formed between the first line and the main surface of the substrate is $\alpha$; a line connecting the light emission central position and an upper end of a section of the first light blocking unit that blocks light from the light emitting unit is a second line; and an angle formed between the second line and the main surface of the substrate is $\beta$.

In addition, it is preferable that: the first light blocking unit be an electric member which is used to cause the light emitting unit to emit light; the electric member be disposed on the main surface of the substrate; and a height from the bottom surface to an upper end of the second light blocking unit be greater than a height from the bottom surface to an upper end of the electric member.

In addition, it is preferable that: the straight tube be a glass tube; the first light blocking unit include (i) an electric member which is used to cause the light emitting unit to emit light, (ii) and a resin which covers an upper portion of the electric member; the first light blocking unit be disposed on the main surface of the substrate; and a height from the bottom surface to an upper end of the second light blocking unit be greater than a height from the bottom surface to an upper end of the resin which covers the upper portion of the electric member.

In addition, it is preferable that $\alpha$ and $\beta$ be defined by a relational equation of $\alpha>\beta$ when: a line connecting (i) a light emission central position which is a center position of a section from which the light emitting unit emits light and (ii) an upper end of the section of the second light blocking unit that blocks light from the light emitting unit is a first line; an angle formed between the first line and the main surface of the substrate is $\alpha$; a line connecting the light emission central position and an upper end of a section of the first light blocking unit that blocks light from the light emitting unit is a second line; and an angle formed between the second line and the main surface of the substrate is $\beta$.

In addition, it is preferable that the second light blocking unit include a reflecting surface formed in a section which receives light from the light emitting unit, the reflecting surface reflects light from the light emitting unit to above the mount.

Accordingly, a luminous flux (an amount of light) of the lamp can be improved.

In addition, it is preferable that: the lamp further include a mount which is disposed in the straight tube and have an elongated shape extending in the tube axis direction; and the second light blocking unit be formed on an end portion of the mount in a short-side direction.

A lamp according to an aspect of the present invention includes: a straight tube; a light emitting unit disposed in the straight tube and extending in a tube axis direction; an electric member which is used to cause the light emitting unit to emit light; and a light blocking unit configured to block a part of light proceeding from the light emitting unit to the electric member in a direction perpendicular to the tube axis direction, wherein the light blocking unit has an end portion having a linear shape in the tube axis direction, the end portion being an end portion of a section of the light blocking unit that blocks light.

Now, let us assume that a shape, in the tube axis direction, of an end portion of a section where the electric member blocks light is a shape with a raised portion. In this case, a shadow created when light is irradiated on the electric member is an unappealing shadow.

According to the present aspect, the light blocking unit blocks light which is a part of light proceeding in a direction perpendicular to the tube axis direction from the light emitting unit and which proceeds toward the electric member. With this configuration, it is possible to prevent unappealing shadows from being created.

A lighting apparatus according to an aspect of the present invention includes the lamp described above.

Advantageous Effects of Invention

According to the present invention, it is possible to prevent unappealing shadows from being created.

DESCRIPTION OF EMBODIMENTS

Figure 1:
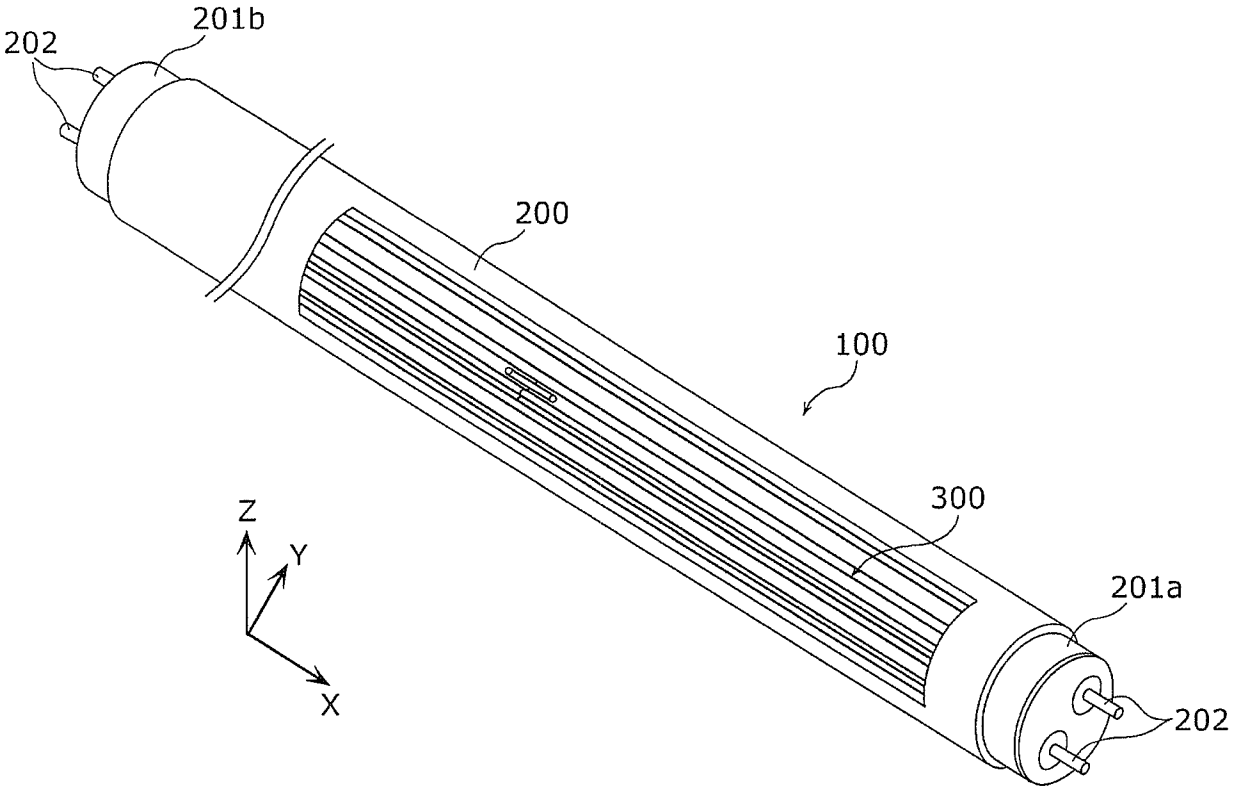
FIG. 1 is a perspective view illustrating an overview of a configuration of an LED lamp according to a first embodiment.

The following describes embodiments according to the present invention with reference to the drawings. In the following description, the same structural elements are assigned with the same reference signs This also applies to their names and functions. Accordingly, detailed descriptions for them may be omitted in some cases.

It should be noted that dimensions, materials, shapes, relative arrangements, and the like of respective components illustrated in the embodiments are to be modified as appropriate depending on configurations of apparatuses to which the present invention is applied and on various conditions, and the present invention is not limited to such illustrated examples. In addition, dimensions of the respective components in the drawings may differ from actual dimensions.

[The First Embodiment]

FIG. 1 is a perspective view illustrating an overview of a configuration of an LED lamp 100 according to the first embodiment. Note that, in FIG. 1, an interior of the LED lamp 100 is illustrated with a part of a straight tube 200 cut away. The LED lamp 100 is a straight tube lamp for general lighting.

In FIG. 1, X, Y, and Z directions are respectively perpendicular to one another. The X, Y, and Z directions in the following drawings are also respectively perpendicular to one another.

Figure 2:
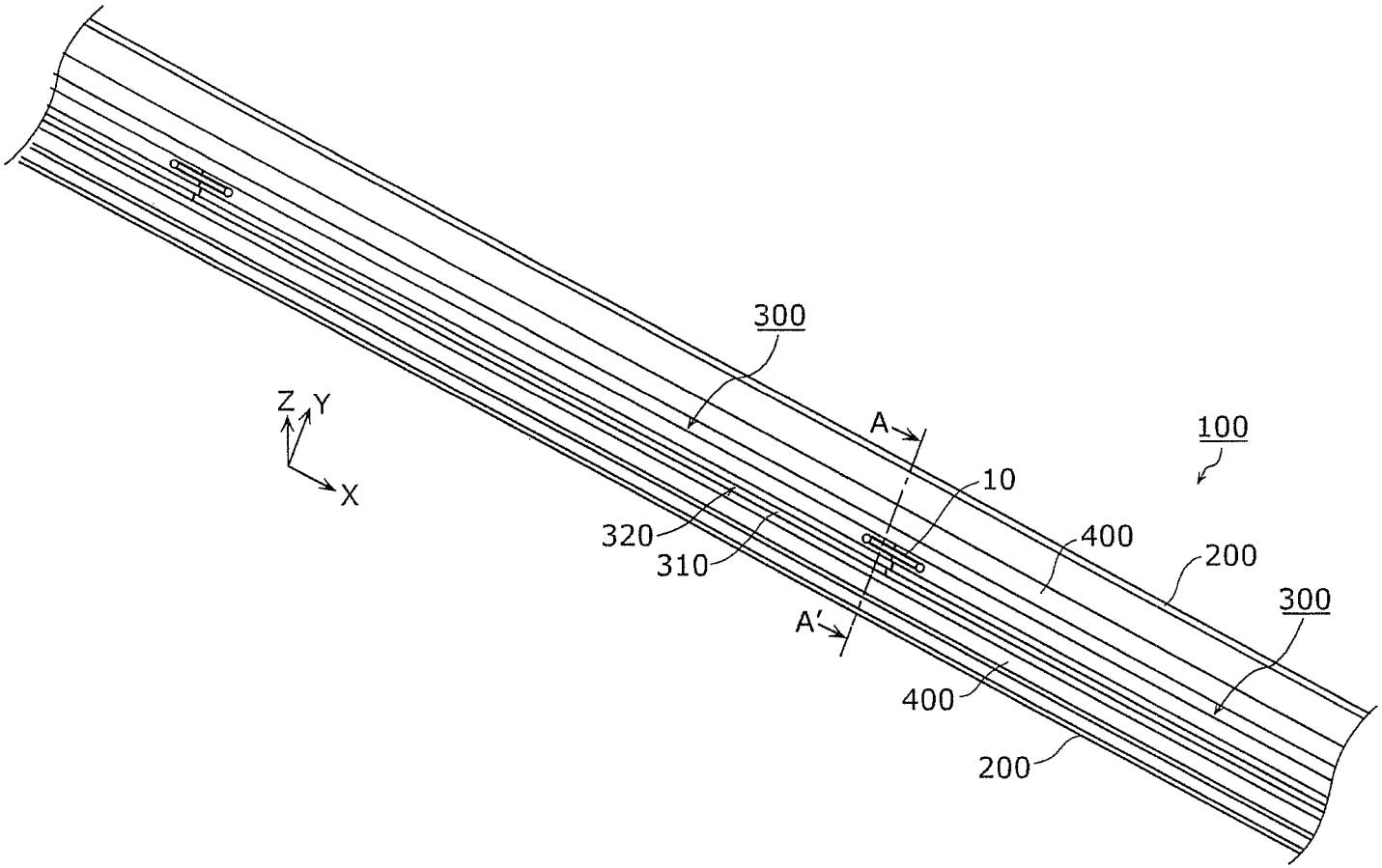
FIG. 2 is a perspective view illustrating, in detail, an internal configuration of the LED lamp according to the first embodiment.

FIG. 2 is a perspective view illustrating, in detail, an internal configuration of the LED lamp 100 according to the first embodiment. FIG. 2 illustrates an interior of the LED lamp 100 as though the straight tube 200 is transparent.

Figure 3:
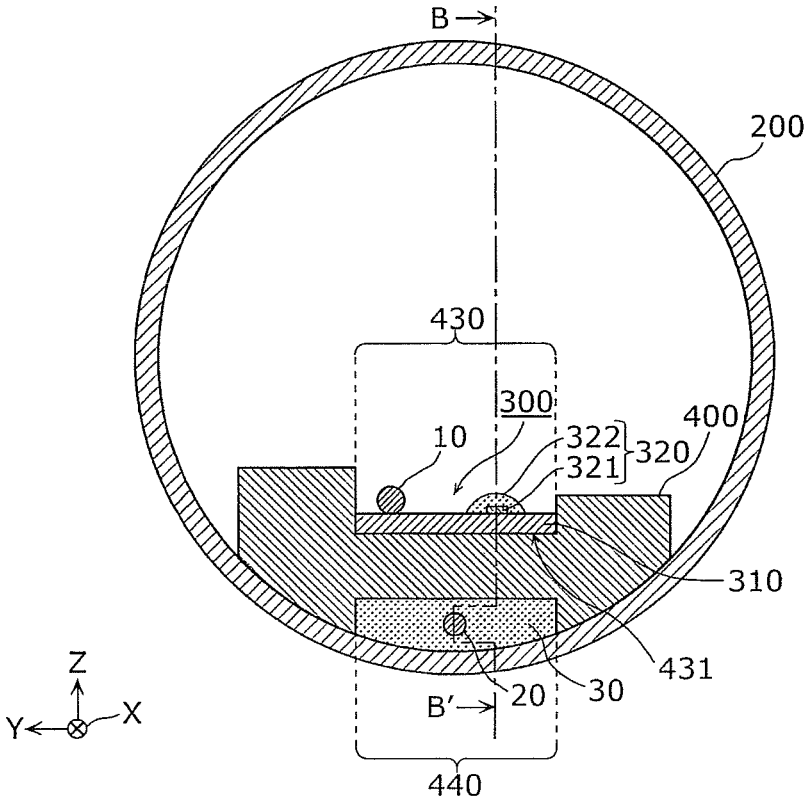
FIG. 3 is a cross-sectional view of the LED lamp according to the first embodiment.

FIG. 3 is a cross-sectional view of the LED lamp 100 according to the first embodiment. More specifically, FIG. 3 is a cross-sectional view of the LED lamp 100 taken along line A-A' in FIG. 2.

Figure 4:
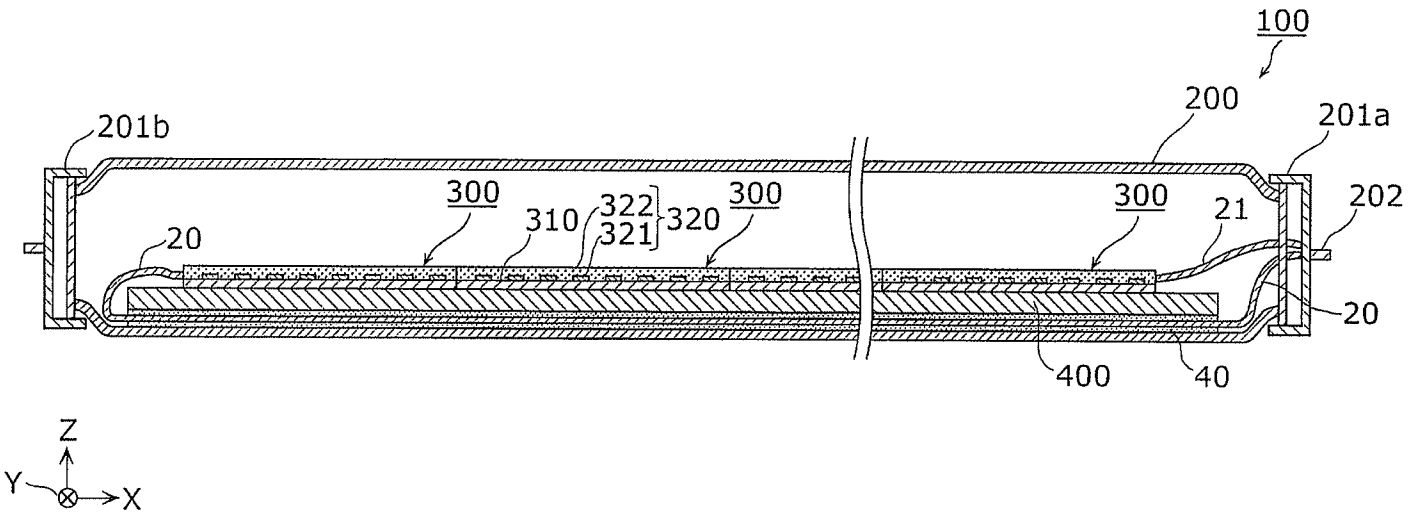
FIG. 4 is a cross-sectional view of the LED lamp according to the first embodiment.

FIG. 4 is a cross-sectional view of the LED lamp 100 according to the first embodiment. More specifically, FIG. 4 is a cross-sectional view of the LED lamp 100 taken along line B-B' in FIG. 3.

With reference to FIGS. 1, 2, 3, and 4, the LED lamp 100 includes the straight tube 200, bases 201*a* and 201*b*, a pair of base pins 202, a plurality of LED modules 300, and a mount 400.

The straight tube 200 has an elongated shape. In addition, the straight tube 200 has a ring-like cross-sectional shape. In the present embodiment, an acrylic tube is used as the straight tube 200. It should be noted that the straight tube 200 is not limited to an acrylic tube and may alternatively be a glass tube, a polycarbonate tube, and the like. For example, the glass tube is made of soda-lime glass containing 70% to 72% of silica ($SiO_2$).

In addition, a contracted portion with a reduced diameter is formed at both end portions of the straight tube 200. Note that, when necessary, an inner surface of the straight tube 200 is subjected to diffusion treatment by applying silica, calcium carbonate, or the like.

The straight tube 200 is a straight tube with same dimensions and specifications as straight tubes used to manufacture fluorescent lamps as prescribed in JIS (Japanese Industrial Standards). For example, respective measurements of the straight tube 200 are 1198 mm in length, 30 mm in outer diameter, and 0.7 mm in thickness.

Bases 201*a* and 201*b* are provided at both end portions of the straight tube 200. Hereinafter, each of the bases 201*a* and 201*b* will also be simply referred to as a base 201. For example, the base 201 is a G-type base. It should be noted that the base 201 is not limited to a G-type base and is to be selected as appropriate according to lighting equipment to which the LED lamp 100 is mounted. The base pin 202 is provided on the base 201.

Note that a lighting circuit (not illustrated) which uses one of or both of the bases 201*a* and 201*b* to receive power and cause LEDs of the LED module 300 to emit light is installed inside or outside the LED lamp 100. For example, the lighting circuit can be constituted by a rectifier circuit made of a diode bridge using four Zener diodes.

For example, the LED lamp 100 according to the present embodiment uses the base 201*a* among the bases 201*a* and 201*b* to supply power to the LED module 300. In this case, the base 201*b* is used for mounting to lighting equipment.

It should be noted that supplying power to the LED module 300 is not limited to the one base 201 but both bases 201*a* and 201*b* may be used instead.

In addition, lines 20 and 21 which are electrically connected to each of the pair of base pins 202 provided on the base 201*a* are arranged in the straight tube 200. Through the lines 20 and 21, DC power converted by a rectifier circuit, not illustrated, is supplied to the LED module 300. In other words, DC power is supplied to the LED module 300 from the base 201*a*. A detailed description of the lines 20 and 21 will be given later.

An elongated mount 400 which extends in a tube axis direction of the straight tube 200 is provided inside the straight tube 200. The tube axis direction is an X direction. Hereinafter, the tube axis direction of the straight tube 200 will also be simply referred to as a tube axis direction.

The mount 400 includes recessed portions 430 and 440. The recessed portion 430 is provided in an upper part of the mount 400. The recessed portion 440 is provided in a lower part of the mount 400. The recessed portions 430 and 440 are recessed portions which extend in the tube axis direction.

In addition, as illustrated in FIG. 3, a region outside a region in which the recessed portion 440 is formed of a rear surface of the mount 400 is constituted by a curved surface portion having a cylindrical surface shape which is formed so as to conform to an inner surface shape of the straight tube 200.

Therefore, a curvature of an outer surface shape of the curved surface portion is the same as a curvature of the inner surface of the straight tube. In the present embodiment, the outer surface shape of the curved surface portion is an arc shape having a curvature with a length (radius) that is half of an inner diameter of the straight tube 200. In addition, as illustrated in FIG. 3, the mount 400 is arranged so that the curved surface portion is in contact with the inner surface of the straight tube 200.

As the recessed portion 440 is filled with an adhesive 30, the mount 400 is joined (bonded) with a lower portion of the inner surface of the straight tube 200. For example, the adhesive 30 is an adhesive made of silicone resin, cement, or the like.

In addition, inorganic particles may be mixed into the adhesive 30 as appropriate in order to increase thermal conductivity of the adhesive 30. The inorganic particles are metallic particles of silver, copper, aluminum, or the like, or non-metallic particles of alumina, aluminum nitride, silicon carbide, graphite, or the like.

It should be noted that, from the perspective of heat-dissipating performance, the adhesive 30 is preferably an adhesive whose thermal conductivity is equal to or higher than 1 W/m·K. In addition, from the perspective of weight reduction, the adhesive 30 is preferably an adhesive whose specific gravity is equal to or lower than 2.

In the present embodiment, a part of the mount 400 and the straight tube 200 are in direct contact with each other, and thermal conduction can be performed directly with a contact section of the straight tube 200 and the mount 400. Therefore, for the purpose of reducing weight of the LED lamp 100, the adhesive 30 is an adhesive which is made of silicone resin and which has a specific gravity that is equal to or lower than 2.

Note that the line 20 extends in the tube axis direction (the X direction) in the recessed portion 440 (the adhesive 30).

A plurality of the LED modules 300 is arranged adjacent to one another in a straight line (one-dimensionally) in the tube axis direction on a bottom surface 431 of the recessed portion 430. Note that, in the present embodiment, eight LED modules 300 are placed in the recessed portion 430 of the mount 400.

The mount 400 also functions as a heat dissipater (heat sink) for dissipating heat of the LED modules 300. Therefore, the mount 400 is preferably constituted by a highly thermal conductive material such as metal. For example, the mount 400 is made of aluminum.

By interposing the mount 400 between the straight tube 200 and the LED modules 300, heat of the LED modules 300 can be efficiently guided to the straight tube 200. Accordingly, heat of the LED modules 300 can be dissipated from an outer surface of the straight tube 200.

Figure 5:
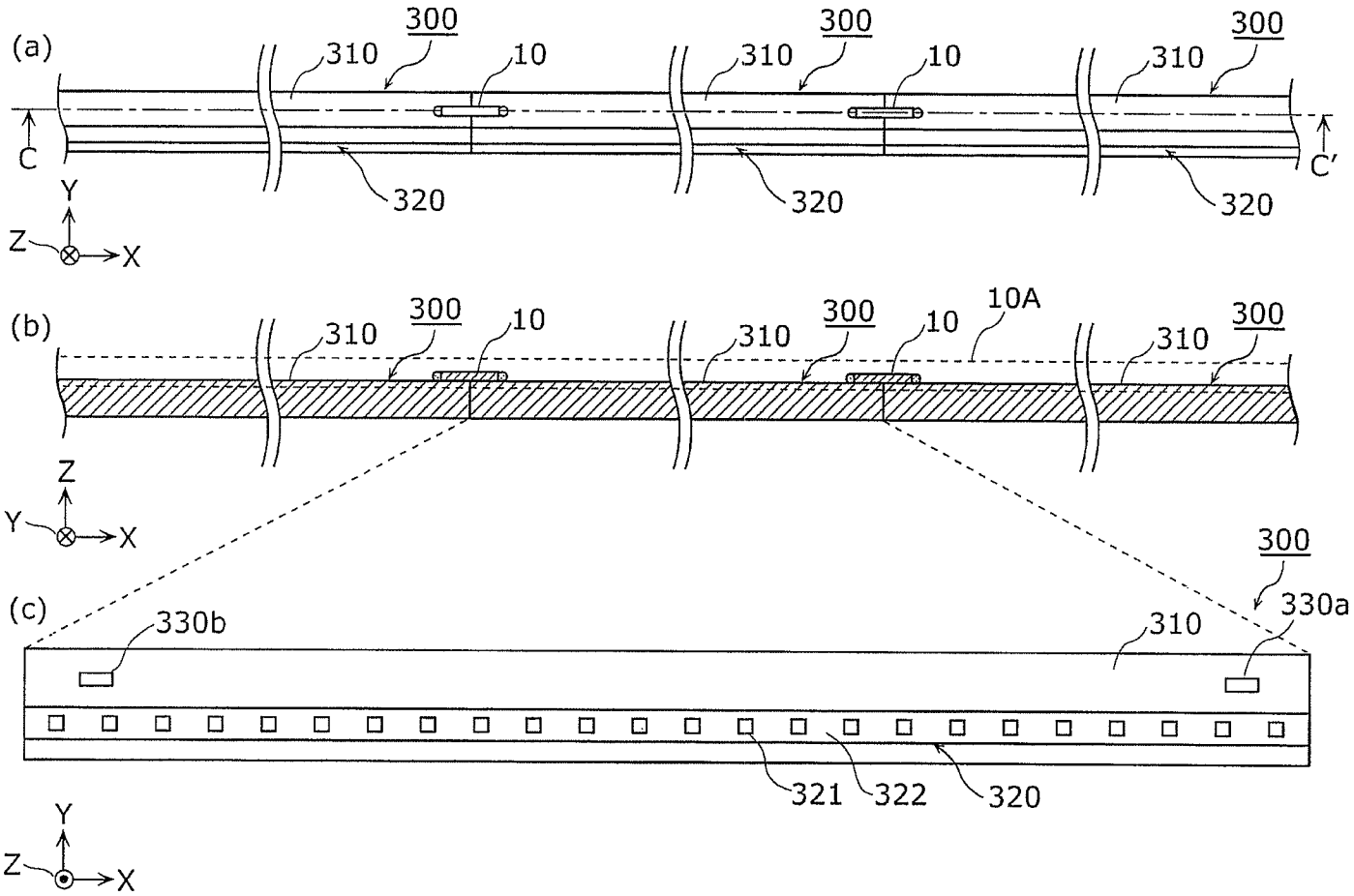
FIG. 5 is a diagram illustrating the LED module according to the first embodiment.

FIG. 5 is a diagram illustrating the LED module 300 according to the first embodiment.

(a) in FIG. 5 is an upper view of the plurality of adjacent LED modules 300.

(b) in FIG. 5 is a cross-sectional view of the plurality of adjacent LED modules 300. More specifically, (b) in FIG. 5 is a cross-sectional view of the plurality of LED modules 300 taken along line C-C' in (a) in FIG. 5.

(c) in FIG. 5 is an upper view of the LED modules 300.

With reference to FIGS. 3, 4, and (a), (b), and (c) in FIG. 5, each LED module 300 includes a substrate 310 and a light emitting unit 320.

The substrate 310 is an elongated substrate which extends in the tube axis direction. For example, the substrate 310 is a ceramic substrate. The substrate 310 is made of translucent aluminum nitride. It should be noted that the substrate 310 may alternatively be a translucent substrate.

Note that the substrate 310 is not limited to a ceramic substrate and may alternatively be a resin substrate, a glass substrate, a flexible substrate, an alumina substrate, or the like.

In addition, the substrate 310 is sized such that the substrate 310 can be arranged inside the straight tube 200. Furthermore, a width and a thickness of the substrate 310 are shorter than the inner diameter of the straight tube 200, and a length of the substrate 310 is shorter than the length of the straight tube 200.

Let us now assume that a length of the substrate 310 in a longitudinal direction (X direction) of the substrate 310 is L1 and a length in a short-side direction (Y direction) of the substrate 310 is L2. In this case, for example, L1 and L2 are defined by a relational equation expressed as $10 \leq L1/L2$. In other words, L1 is equal to or greater than 10 times L2.

For example, respective measurements of the substrate 310 according to the present embodiment are 140 mm in long side length (a length in the longitudinal direction (X direction)), 5.5 to 7 mm in short side length (a length in the short-side direction (Y direction)), and 1 mm in thickness.

The substrate 310 is provided on the bottom surface 431 of the recessed portion 430 of the mount 400. The LED lamp 100 includes the plurality of LED modules 300.

In other words, the LED lamp 100 includes a plurality of the substrates 310 and a plurality of the light emitting units 320. The plurality of substrates 310 is arranged adjacent to one another in the tube axis direction. In other words, the plurality of substrates 310 is linearly (one-dimensionally) arranged.

The light emitting unit 320 which emits light is provided on a main surface of the substrate 310. Hereinafter, in the present specification, the main surface of the substrate 310 is assumed to be a surface on which the light emitting unit 320 is provided.

More specifically, on the main surface of the substrate 310, the light emitting unit 320 is formed to edges of both longitudinal ends of the substrate 310. In other words, the light emitting unit 320 is formed in a seamless manner from one short side end surface of the substrate 310 to the opposing other short side end surface of the substrate 310.

The light emitting unit 320 has an elongated shape. In other words, the light emitting unit 320 is provided on the main surface of the substrate 310 so as to extend in the tube axis direction.

The substrate 310 is provided in the straight tube 200. In other words, the light emitting unit 320 is provided in the straight tube 200 so as to extend in the tube axis direction.

As described earlier, the plurality of substrates 310 is arranged adjacent to one another in the tube axis direction. In other words, the plurality of light emitting units 320 is respectively provided on the main surfaces of the plurality of substrates 310 so as to extend in the tube axis direction. Specifically, end portions of two adjacent light emitting units 320 come into contact with each other. Accordingly, light emitted by the plurality of light emitting units 320 becomes light which is seamless in the tube axis direction.

Electrodes 330*a* and 330*b* are formed on the main surface of the substrate 310.

The light emitting unit 320 is constituted by a plurality of LEDs 321 and a sealing member 322.

The plurality of LEDs 321 is linearly mounted to the main surface of the substrate 310 in the longitudinal direction (tube axis direction) of the substrate 310. In the present embodiment, as an example, 24 LEDs 321 are mounted to each substrate 310.

The LED 321 is a bare chip which emits visible light in a single color. The LED 321 is flip-chip mounted or mounted by wire bonding on a wiring pattern (not illustrated) formed on the substrate 310. For example, the LED 321 is a blue LED chip which emits blue light. A blue LED chip is a gallium nitride semiconductor light emitting element with a central wavelength of 440 nm to 470 nm and made of an InGaN-based material.

The plurality of LEDs 321 included in the light emitting unit 320 is electrically connected in series by a wiring pattern, not illustrated, formed on the surface of the substrate 310.

Hereinafter, the plurality of LEDs 321 included in the light emitting unit 320 will be collectively referred to as a LED group.

In (c) in FIG. 5, the LED 321 at a right end among the plurality of LEDs 321 constituting the LED group is electrically connected to the electrode 330*a*. The LED 321 at a left end among the plurality of LEDs 321 constituting the LED group is electrically connected to the electrode 330*b*.

As illustrated in (a) and (b) in FIG. 5, among two adjacent substrates 310, the electrode 330*a* of the left-side substrate 310 and the electrode 330*b* of the right-side substrate 310 are electrically connected by the line 10. In other words, the line 10 as an electric member for electrically connecting two adjacent light emitting units 320 is provided in a vicinity of a boundary between the two adjacent light emitting units 320.

It should be noted that the electric member is not limited to the line 10. For example, the electric member may alternatively be constituted by the line 10 and solder provided at the line 10.

The line 10 is constituted by a core wire made of a conductive member and coating which covers the core wire. For example, the conductive member is copper. A sectional shape of the line 10 is a circle. For example, a diameter of the circle ranges from 1 to 1.5 millimeters.

It should be noted that the shape of the line 10 is not limited to the shape described above and a wiring with a rectangular sectional shape may be used instead. In addition, the line 10 is not limited to a configuration having a coating and a metallic line without a coating may be used instead.

One end and another end of the line 10 are respectively electrically connected to the electrode 330*a* and the electrode 330*b* by solder or the like. In other words, the plurality of LED groups respectively corresponding to the plurality of substrates 310 arranged adjacent to one another in the tube axis direction are electrically connected in series by the line 10.

As described above, lines 20 and 21 are arranged in the straight tube 200. The line 21 is electrically connected to the electrode 330*a* of the substrate 310 in the LED module 300 which is placed at a location nearest to the base 201*a*.

On the other hand, the line 20 extends to the base 201*b* on an opposite side to the base 201*a*. In addition, the line 20 is electrically connected to the electrode 330*b* of the substrate 310 in the LED module 300 which is placed at a location farthest from the base 201*a*.

By electrically connecting the lines 20 and 21 to the plurality of LED modules 300 in this manner, all of the LEDs 321 in the straight tube 200 can be connected in series. As a result, power can be supplied to all of the LEDs 321 in the straight tube 200 by the lines 20 and 21.

As illustrated in (b) in FIG. 5, a line unit 10A is constituted (formed) by the plurality of (all of) the lines 10 included in the LED lamp 100. It should be noted that when two LED modules 300 are included in the LED lamp 100, the line unit 10A is constituted by one line 10. In other words, the line unit 10A is constituted by one or more lines 10.

The sealing member 322 collectively seals all LEDs 321 mounted to one substrate 310. On the main surface of the substrate 310, the sealing member 322 is formed to the edges of both longitudinal ends of the substrate 310. In other words, the sealing member 322 is formed in a seamless manner from one short side end surface of the substrate 310 to the opposing other short side end surface of the substrate 310.

The sealing member 322 has a dome shape with a section which is convex upward and approximately semicircular. In addition, the sealing member 322 is a phosphor-containing resin which contains phosphor that is a wavelength converter. Furthermore, the sealing member 322 is a wavelength converting layer which converts a wavelength of light from the LEDs 321.

In addition, the wavelength converting layer includes an optical wavelength converter for converting a wavelength of light. In the present embodiment, the sealing member 322 which is a wavelength converting layer includes phosphor as an optical wavelength converter.

Therefore, the sealing member 322 is a phosphor layer including phosphor particles which excite light from the LEDs 321. It should be noted that yellow phosphor particles are used as the phosphor particles, and a phosphor-containing resin 22 is constructed by dispersing yellow phosphor particles in silicone resin.

For example, the yellow phosphor particles are a YAG (yttrium aluminum garnet) phosphor material. It should be noted that the yellow phosphor particles are not limited to a YAG phosphor material and, for example, a silicate phosphor material may be used instead.

As described above, the light emitting unit 320 is constituted by a plurality of LEDs 321 as blue LED chips and the sealing member 322 containing yellow phosphor particles. Therefore, the yellow phosphor particles are excited by blue light from the blue LED chips and release yellow light. Accordingly, white light is released from the light emitting unit 320 due to the excited yellow light and the blue light from the blue LED chips.

Next, a configuration of the mount according to the present embodiment will be described in detail.

Figure 6:
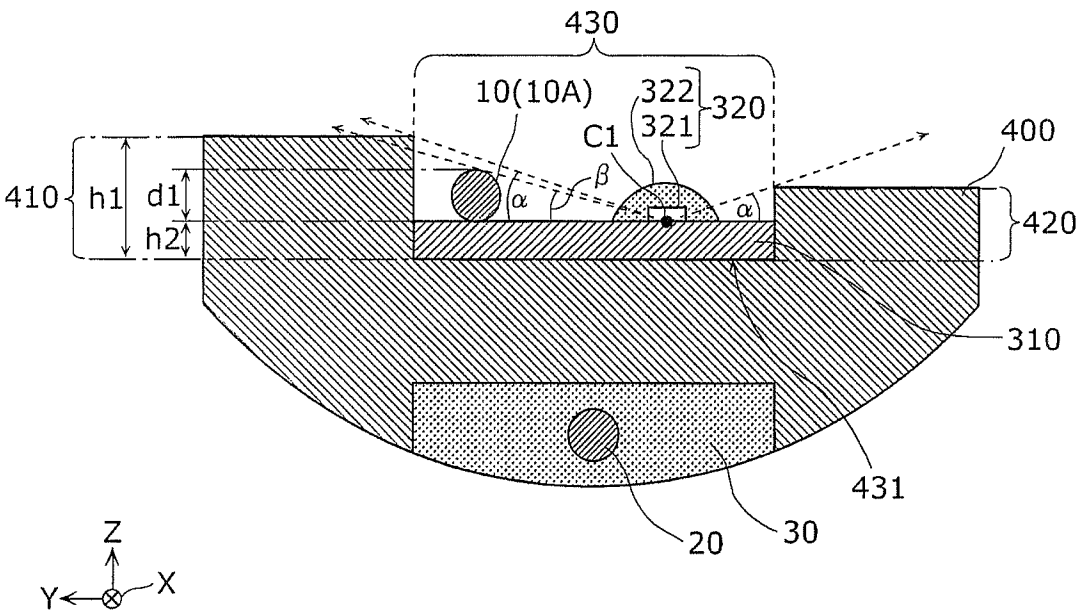
FIG. 6 is a cross-sectional view of a mount according to the first embodiment.

FIG. 6 is a cross-sectional view of the mount 400 according to the first embodiment. More specifically, FIG. 6 is a cross-sectional view of the mount 400 taken along line A-A' in FIG. 2. It should be noted that the line 20 and the adhesive 30 which are not included in the mount 400 are also illustrated in FIG. 6.

The mount 400 has a shape in which a same shape (a shape illustrated in FIG. 6) continues from one end to another end of the mount 400 in a longitudinal direction.

The mount 400 includes raised portions 410 and 420. The raised portions 410 and 420 are respectively parts of the mount 400.

Each of the raised portions 410 and 420 has a shape which is the same shape from one end to the other end of the mount 400 in the longitudinal direction. In other words, the mount 400 includes raised portions 410 and 420 which have the same shape from one end to the other end of the mount 400 in the longitudinal direction.

Of the raised portion 410, a shape in the tube axis direction of an upper end portion (end portion) of a section where the raised portion 410 blocks light from the light emitting unit 320 is a linear shape. In the present specification, an upper end portion refers to an upper-side end portion when assuming that a side where a light emitting unit (for example, the light emitting unit 320) emits light is an upper side. In other words, in the present specification, an upper end portion refers to an end portion on a light emitting side of the light emitting unit.

In addition, of the raised portion 420, a shape in the tube axis direction of an upper end portion of a section where the raised portion 420 blocks light from the light emitting unit 320 is a linear shape.

Hereinafter, a component which blocks a part of light proceeding in a direction perpendicular to the tube axis direction from the light emitting unit 320 will be referred to as a light blocking unit A. In the present embodiment, the line unit 10A is the light blocking unit A.

In other words, the light blocking unit A is constituted by the line 10 as one or more electric members arranged in the tube axis direction. In addition, the line unit 10A as the light blocking unit A is arranged on the main surface of the plurality of substrates 310 adjacent to one another in the tube axis direction.

As described earlier, note that the electric member is not limited to the line 10. For example, the electric member may alternatively be constituted by the line 10 and solder provided at the line 10.

Hereinafter, a component which blocks light not blocked by the light blocking unit A among light proceeding in a direction perpendicular to the tube axis direction from a light emitting unit will be referred to as a light blocking unit B. In this case, the light emitting unit is the light emitting unit 320.

In this case, light which is not blocked by the light blocking unit A among light proceeding in a direction perpendicular to the tube axis direction from a light emitting unit is light which passes through a region (hereinafter referred to as a region A) enclosed by a line parallel to the tube axis direction which is in contact with an uppermost part of a section which blocks light from a light emitting unit among the light blocking unit A and by the light blocking unit A.

For example, in (b) in FIG. 5, an uppermost part of a section which blocks light from a light emitting unit among the light blocking unit A refers to an uppermost part of the line unit 10A or, in other words, an uppermost part of the one or more lines 10 which constitute the line unit 10A.

In other words, for example, in (b) in FIG. 5, the region A is a region enclosed by a line parallel to the tube axis direction which is in contact with the uppermost part of the line unit 10A and by the line unit 10A and in which the line unit 10A does not exist.

In other words, the light blocking unit B at least blocks light which is not blocked by the light blocking unit A among light proceeding in a direction perpendicular to the tube axis direction from a light emitting unit and which is light passing through a region enclosed by a line parallel to the tube axis direction which is in contact with an uppermost part of a section which blocks light from a light emitting unit among the light blocking unit A and by the light blocking unit A.

In the present embodiment, the raised portion 410 is the light blocking unit B.

Let us now assume that a height of an upper end of the light blocking unit B (the raised portion 410) from the bottom surface 431 of the recessed portion 430 is h1 and a thickness of the substrate 310 is h2. In other words, h2 is a height to an upper end (main surface) of the substrate 310 from the bottom surface 431.

It should be noted that, in the present specification, an upper end refers to an upper-side end when assuming that a side where a light emitting unit (for example, the light emitting unit 320) emits light is an upper side. In other words, in the present specification, an upper end refers to an end on a light emitting side of a light emitting unit.

In addition, a height to an upper end of the light blocking unit A (the line unit 10A described earlier) from the main surface of the substrate 310 is assumed to be d1. The line unit 10A as the light blocking unit A is constituted by one or more lines 10.

Note that when each line 10 is in contact with the main surface of the substrate 310 and a height to an upper end of each line 10 from the main surface of the substrate 310 is the same, d1 may be equal to a diameter of the line 10.

It should also be noted that, depending on a state of connection of solder or the like, there are cases where the line 10 does not come into contact with the substrate 310. In this case, d1 is equal to a height to an upper end of the line 10 from the main surface of the substrate 310. In this case, the line 10 which is a definition object of d1 is the line 10 located at a highest position from the bottom surface 431 among the one or more lines 10 provided on the main surface of the plurality of substrates 310.

In other words, d1 is equal to the height to an upper end of the line unit 10A from the main surface of the substrate 310.

In this case, h1 is defined by Expressions 1 and 2 below as relational equations.

$$h1>h2 \qquad \text{Expression 1}$$

$$h1>h2+d1 \qquad \text{Expression 2}$$

Expression 1 defines the height to an upper end of the light blocking unit B from the bottom surface 431 to be greater than the thickness of the substrate 310. Expression 2 defines the height (h1) to the upper end of the light blocking unit B from the bottom surface 431 to be greater than the height (h2+d1) to the upper end of the light blocking unit A from the bottom surface 431.

Hereinafter, a center position of a section from which the light emitting unit 320 emits light will be referred to as a light emission central position C1. The light emission central position C1 is a center position of an active layer of the LEDs 321 included in the light emitting unit 320.

Let us now assume that, as illustrated in FIG. 6, a line connecting the light emission central position C1 and an upper end of a section which blocks light from the light emitting unit 320 among the light blocking unit B (the raised portion 410) is a first line. In addition, an angle formed between the first line and the main surface of the substrate 310 is assumed to be $\alpha$.

Let us also assume that a line connecting the light emission central position C1 and an upper end of a section which blocks light from the light emitting unit 320 among the light blocking unit A is a second line. In addition, an angle formed between the second line and the main surface of the substrate 310 is assumed to be $\beta$.

In this case, angles $\alpha$ and $\beta$ are defined by Expression 3 below as a relational equation.

$$\alpha>\beta \qquad \text{Expression 3}$$

Here, in the raised portion 410 as the light blocking unit B, a shape in the tube axis direction of an upper end portion (end portion) of a section where the raised portion 410 blocks light is a linear shape.

Next, an advantageous effect produced by the raised portion 410 defined as above will be described.

Figure 7:
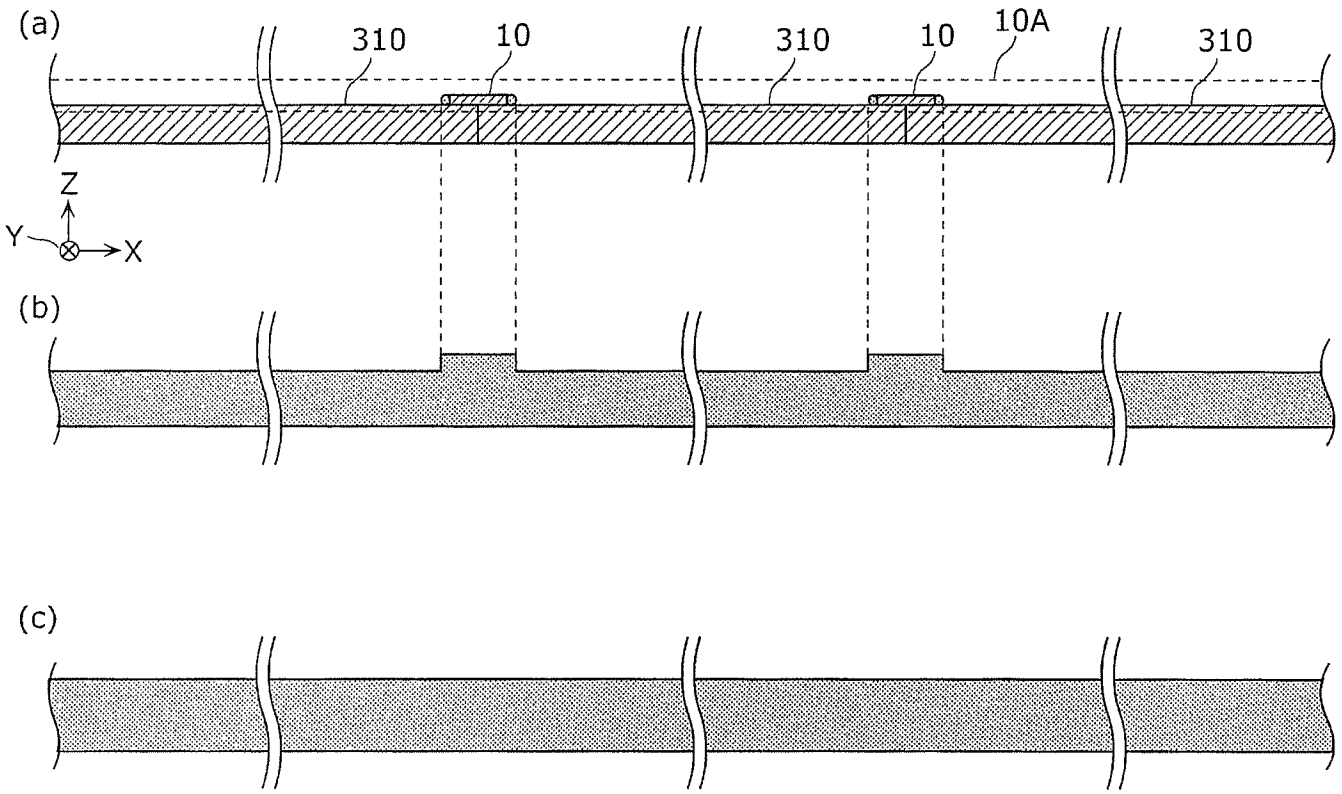
FIG. 7 is a diagram for describing a shadow created by light from a light emitting unit.

FIG. 7 is a diagram for describing a shadow created by light from a light emitting unit 320.

(a) in FIG. 7 is a cross-sectional view of the plurality of LED modules 300 taken along line C-C' in (a) in FIG. 5.

(b) in FIG. 7 is a diagram illustrating a shadow projected onto a section in the tube axis direction in an inner surface of the straight tube 200 when the raised portion 410 is not provided.

As illustrated in (b) in FIG. 7, when the raised portion 410 is not provided, a shadow projected onto the inner surface of the straight tube 200 is an unappealing shadow having a raised portion which is a projection of a shape of the line 10 (the line unit 10A). In other words, when the raised portion 410 is not provided, an unappealing shadow is projected onto the inner surface of the straight tube 200. That is, an unappealing shadow is created when the raised portion 410 is not provided.

(c) in FIG. 7 is a diagram illustrating a shadow projected onto a section in the tube axis direction in the inner surface of the straight tube 200 according to the configuration of the present embodiment. As illustrated in (c) in FIG. 7, by providing the raised portion 410 satisfying Expressions 1 to 3, a shadow whose upper end portion has a linear shape is projected onto the inner surface of the straight tube 200.

As described above, with the LED lamp 100 according to the first embodiment, a shadow created due to the raised portion 410 blocking light covers a shadow ((c) in FIG. 7) created due to the line unit 10A blocking light. In addition, in the raised portion 410 as the light blocking unit B, a shape in the tube axis direction of an upper end portion (end portion) of a section where the raised portion 410 blocks light is a linear shape.

Therefore, an unappealing shadow can be prevented from being projected onto a section in the tube axis direction in the inner surface of the straight tube 200. In other words, it is possible to prevent unappealing shadows from being created.

Accordingly, a decline in an aesthetic appearance of the LED lamp 100 attributable to an occurrence of an unappealing shadow can be prevented. In addition, an unevenness in a brightness of light irradiated from the LED lamp 100 attributable to an occurrence of an unappealing shadow can be suppressed.

It should be noted that a definition of the angles $\alpha$ and $\beta$ are not limited to Expression 3 and the angles $\alpha$ and $\beta$ may alternatively be defined by Expression 4 below.

$$\alpha > \beta/2 \qquad \text{Expression 4}$$

In this case, a height of a raised portion illustrated in (b) in FIG. 7 can be reduced. Accordingly, an amount of light blocked by the raised portion 410 can be reduced. In this case, an unappealing shadow can be made less prominent and, at the same time, a luminous flux (amount of light) of the LED lamp 100 can be improved.

It should be noted that the raised portion 420 is also preferably formed so as to satisfy the definitions satisfied by the raised portion 410. In other words, as illustrated in FIG. 6, let us assume that a line connecting the light emission central position C1 and an upper end of a section which blocks light from the light emitting unit 320 among the raised portion 420 is a third line.

In this case, a height and a shape of the raised portion 420 are defined so that an angle formed between the third line and the main surface of the substrate 310 is equal to $\alpha$.

In this case, a shadow illustrated in (c) in FIG. 7 is projected at a same height in a vicinity of both end portions of the mount 400 in the inner surface of the straight tube 200. Therefore, an aesthetic appearance of the LED lamp 100 during light emission can be improved.

[The First Modification of the First Embodiment]

Next, an LED lamp (hereinafter, referred to as an LED lamp A1) according to a first modification of the first embodiment will be described.

The first embodiment describes a configuration of an LED lamp in which the straight tube 200 is an acrylic tube. With the LED lamp A1 according to the first modification of the first embodiment, a glass tube is adopted as the straight tube 200. In this case, for example, each line 10 is sealed by a silicon resin.

Figure 8:
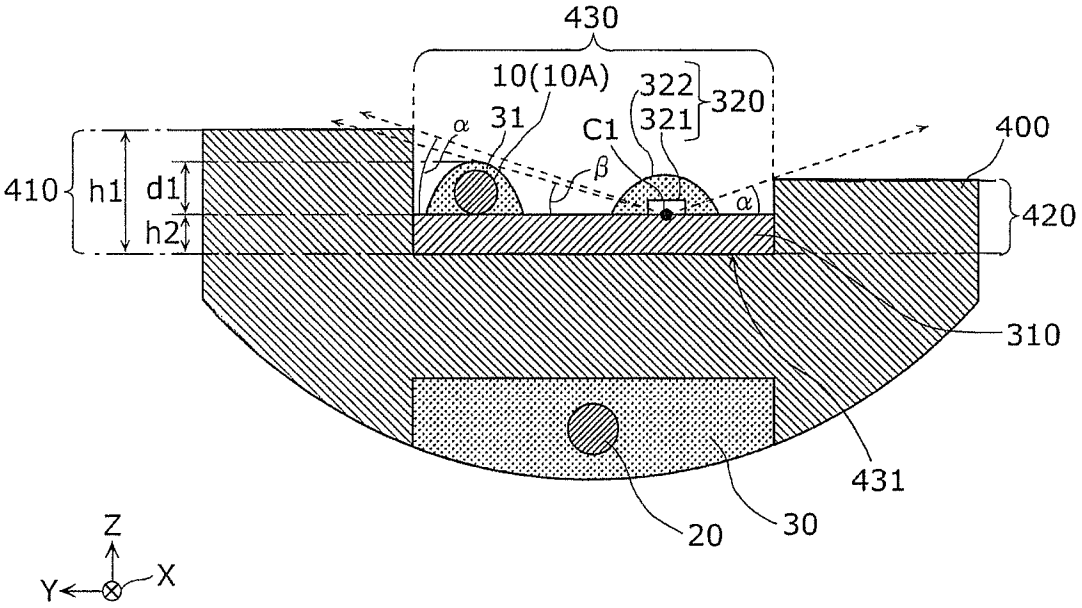
FIG. 8 is a cross-sectional view of a mount according to Modification 1 of the first embodiment.

FIG. 8 is a cross-sectional view of the mount 400 according to the first modification of the first embodiment. More specifically, FIG. 6 is a cross-sectional view of the mount 400 taken along line A-A' in FIG. 2.

With reference to FIG. 8, the line 10 is sealed in its entirety by a resin 31. In other words, an upper part of the line 10 is covered by the resin 31. For example, the resin 31 is a silicon resin.

It should be noted that the resin 31 is not limited to a silicon resin and other resins may be used instead.

In other words, by comparing the LED lamp A1 with the LED lamp 100, the LED lamp A1 differs from the LED lamp 100 in that the straight tube 200 is a glass tube and the line 10 is sealed by the resin 31. Since a configuration of the LED lamp A1 is otherwise similar to that of the LED lamp 100, a detailed description will not be repeated.

In this case, the light blocking unit A described earlier according to the first modification of the first embodiment is constituted by one or more lines 10 as electric members and the resin 31 which covers respective upper parts of the one or more lines 10.

As described earlier, note that the electric member is not limited to the line 10. For example, the electric member may alternatively be constituted by the line 10 and solder provided at the line 10.

In addition, in this case, d1 according to the first modification of the first embodiment is a height to an upper end of the resin 31 covering respective upper parts of the one or more lines 10 which constitute the line unit 10A from the main surface of the substrate 310.

It should be noted that the light blocking unit B described earlier according to the first modification of the first embodiment is the same as the light blocking unit B according to the first embodiment. Therefore, h1 and h2 according to the first modification of the first embodiment are the same as h1 and h2 according to the first embodiment. Even in this case, Expressions 1 to 3 described earlier are satisfied.

Therefore, with the LED lamp A1 according to the first modification of the first embodiment, similar advantageous effects as the first embodiment are achieved. In other words, it is possible to prevent unappealing shadows from being created.

[The Second Modification of the First Embodiment]

Next, an LED lamp (hereinafter, referred to as an LED lamp A2) according to a second modification of the first embodiment will be described.

By comparing the LED lamp A2 with the LED lamp 100, the LED lamp A2 differs from the LED lamp 100 in that the LED lamp A2 further includes fixing portions 40*a* and 40*b*. Since a configuration of the LED lamp A2 is otherwise similar to that of the LED lamp 100, a detailed description will not be repeated.

Figure 9:
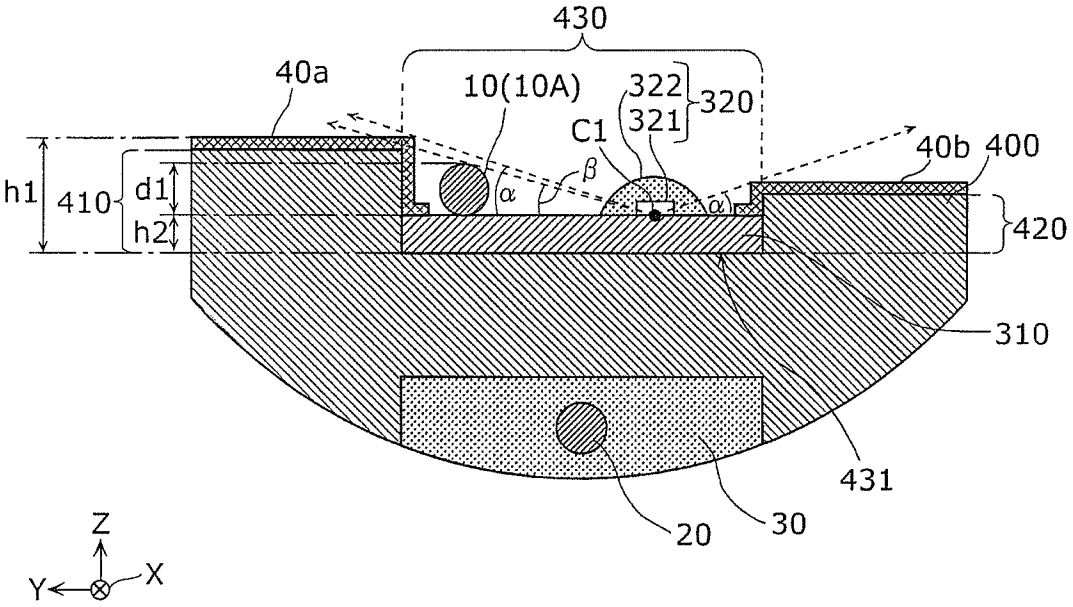
FIG. 9 is a cross-sectional view of a mount according to Modification 2 of the first embodiment.

FIG. 9 is a cross-sectional view of the mount 400 according to the second modification of the first embodiment. More specifically, FIG. 9 is a cross-sectional view of the mount 400 taken along line A-A' in FIG. 2.

With reference to FIG. 9, the fixing portions 40*a* and 40*b* are for fixing the substrate 310 to the mount 400. The fixing portion 40*a* extends from one end to the other end of the mount 400 in a longitudinal direction. In other words, the fixing portion 40*a* has a same shape from one end to the other end of the mount 400 in the longitudinal direction.

Among the fixing portion 40*a*, a shape in the tube axis direction of an upper end portion (end portion) of a section where the fixing portion 40*a* blocks light from the light emitting unit 320 is a linear shape. For example, the fixing portion 40*a* is made of metal.

The fixing portion 40*a* is provided so as to cover a part of the raised portion 410 and an upper part of the part of the raised portion 410. The fixing portion 40*a* is fixed to the upper part of the raised portion 410 by a screw or the like. The fixing portion 40*a* has a shape such that a part of the fixing portion 40*a* comes into contact with an end portion of a main surface of the substrate 310 when the fixing portion 40*a* is fixed to the upper part of the raised portion 410. In other words, the fixing portion 40*a* comes into contact with the main surface of the substrate 310 so as to fix the substrate 310 to the mount 400.

In this case, the light blocking unit B described earlier according to the second modification of the first embodiment is constituted by a part (the raised portion 410) of the mount 400 and the fixing portion 40*a* provided so as to cover an upper part of a part of the mount 400. In addition, in this case, h1 according to the second modification of the first embodiment is a height to an upper end of the fixing portion 40*a* from the bottom surface 431.

It should be noted that the light blocking unit A described earlier according to the second modification of the first embodiment is the same as the light blocking unit A according to the first embodiment. Therefore, d1 and h2 according to the second modification of the first embodiment are the same as d1 and h2 according to the first embodiment. Even in this case, Expressions 1 to 3 described earlier are satisfied.

Therefore, with the LED lamp A2 according to the first modification of the first embodiment, similar advantageous effects as the first embodiment are achieved. In other words, it is possible to prevent unappealing shadows from being created.

It should be noted that the fixing portion 40*b* extends from one end to the other end of the mount 400 in a longitudinal direction. In other words, the fixing portion 40*b* has a same shape from one end to the other end of the mount 400 in the longitudinal direction.

In the fixing portion 40*b*, a shape in the tube axis direction of an upper end portion (end portion) of a section where the fixing portion 40*b* blocks light from the light emitting unit 320 is a linear shape. For example, the fixing portion 40*b* is made of metal.

The fixing portion 40*b* is provided so as to cover a part of the raised portion 420 and an upper part of the part of the raised portion 420. The fixing portion 40*b* is fixed to the upper part of the raised portion 420 by a screw or the like. The fixing portion 40*b* has a shape such that the part of the fixing portion 40*b* comes into contact with an end portion of a main surface of the substrate 310 when the fixing portion 40*b* is fixed to the upper part of the raised portion 420.

It should be noted that the raised portion 420 and the fixing portion 40*b* which covers the upper part of the raised portion 420 are preferably also formed so as to satisfy the definitions satisfied by the light blocking unit B according to the second modification of the first embodiment. In other words, as illustrated in FIG. 9, let us assume that a line connecting the light emission central position C1 and an upper end of a section which blocks light from the light emitting unit 320 among the fixing portion 40*b* is a third line.

In this case, a height and a shape of the raised portion 420 are defined so that an angle formed between the third line and the main surface of the substrate 310 is equal to $\alpha$.

In this case, a shadow illustrated in (c) in FIG. 7 is projected at a same height in a vicinity of both end portions of the mount 400 in the inner surface of the straight tube 200 in a similar manner to the first embodiment. Therefore, an aesthetic appearance of the LED lamp A2 during light emission can be improved.

It should be noted that when a glass tube is used as the straight tube 200 in the second modification of the first embodiment, the light blocking unit A described earlier according to the second modification of the first embodiment is constituted by one or more lines 10 as electric members and the resin 31 which covers respective upper parts of the one or more lines 10.

[The Third Modification of the First Embodiment]

Next, an LED lamp (hereinafter, referred to as an LED lamp A3) according to a third modification of the first embodiment will be described.

By comparing the LED lamp A3 with the LED lamp 100, the LED lamp A3 differs from the LED lamp 100 in that the LED lamp A3 includes a mount 400A in place of the mount 400. Since a configuration of the LED lamp A2 is otherwise similar to that of the LED lamp 100, a detailed description will not be repeated.

Figure 10:
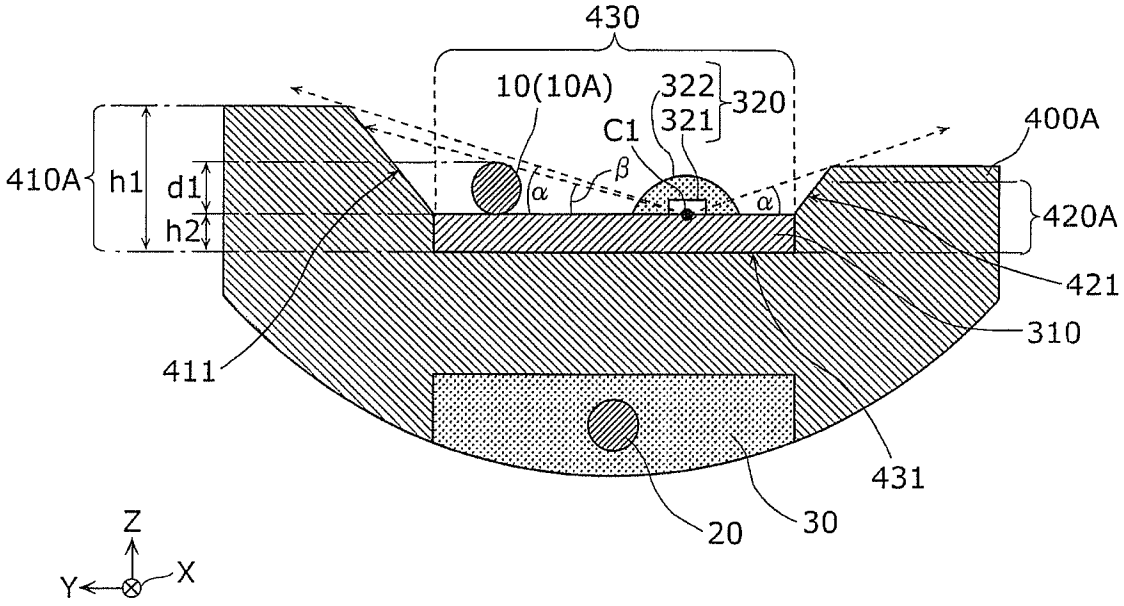
FIG. 10 is a cross-sectional view of a mount according to Modification 3 of the first embodiment.

FIG. 10 is a cross-sectional view of the mount 400 according to the third modification of the first embodiment. More specifically, FIG. 10 is a cross-sectional view of the mount 400A taken along line A-A' in FIG. 2 in a case where the mount 400 is replaced with the mount 400A.

The mount 400A has a shape in which a same shape (a shape illustrated in FIG. 10) continues from one end to another end of the mount 400A in a longitudinal direction.

By comparing the mount 400A with the mount 400 illustrated in FIG. 6, the mount 400A differs from the mount 400 in that the mount 400A includes a raised portion 410A in place of the raised portion 410 and a raised portion 420A in place of the raised portion 420. Since a configuration of the mount 400A is otherwise similar to that of the mount 400, a detailed description will not be repeated.

A reflecting surface 411 is formed in the raised portion 410A. A reflecting surface 421 is formed in the raised portion 420A. Each of the raised portions 410A and 420A has a shape which is the same shape from one end to the other end of the mount 400A in the longitudinal direction.

In the raised portion 410A, a shape in the tube axis direction of an upper end portion (end portion) of a section where the raised portion 410A blocks light from the light emitting unit 320 is a linear shape. In addition, in the raised portion 420A, a shape in the tube axis direction of an upper end portion (end portion) of a section where the raised portion 420A blocks light from the light emitting unit 320 is a linear shape.

Each of the reflecting surfaces 411 and 421 is a surface which reflects light from the light emitting unit 320 toward above the mount 400A.

The light blocking unit B according to the third modification of the first embodiment is the raised portion 410A. In other words, the reflecting surface 411 which reflects light from the light emitting unit 320 toward above the mount 400A is formed in a section which receives light from the light emitting unit 320 among the light blocking unit B.

In this case, h1 according to the third modification of the first embodiment is a height to an upper end of the raised portion 410A from the bottom surface 431.

It should be noted that the light blocking unit A described earlier according to the third modification of the first embodiment is the same as the light blocking unit A according to the first embodiment. Therefore, d1 and h2 according to the third modification of the first embodiment are the same as d1 and h2 according to the first embodiment. Even in this case, Expressions 1 to 3 described earlier are satisfied.

Therefore, with the LED lamp A3 according to the third modification of the first embodiment, similar advantageous effects as the first embodiment are achieved. In other words, it is possible to prevent unappealing shadows from being created.

Furthermore, with the LED lamp A3 according to the third modification of the first embodiment, a part of light from the light emitting unit 320 can be reflected toward above the mount 400A by the reflecting surfaces 411 and 412. Accordingly, a luminous flux (amount of light) of the LED lamp A3 can be more improved than in the LED lamp 100.

It should be noted that the raised portion 420A is preferably also formed so as to satisfy the definitions satisfied by the light blocking unit B according to the third modification of the first embodiment. In other words, as illustrated in FIG. 10, let us assume that a line connecting the light emission central position C1 and an upper end of a section which blocks light from the light emitting unit 320 among the raised portion 420A is a third line. In this case, a height and a shape of the raised portion 420A are defined so that an angle formed between the third line and the main surface of the substrate 310 is equal to a.

In this case, a shadow illustrated in (c) in FIG. 7 is projected at a same height in a vicinity of both end portions of the mount 400 among the inner surface of the straight tube 200 in a similar manner to the first embodiment. Therefore, an aesthetic appearance of the LED lamp A3 during light emission can be improved.

It should be noted that when a glass tube is similarly used as the straight tube 200 in the third modification of the first embodiment, the light blocking unit A described earlier according to the third modification of the first embodiment is constituted by one or more lines 10 as electric members and the resin 31 which covers respective upper parts of the one or more lines 10.

[The Fourth Modification of the First Embodiment]

Next, an LED lamp (hereinafter, referred to as an LED lamp A4) according to a fourth modification of the first embodiment will be described.

By comparing the LED lamp A4 with the LED lamp 100, the LED lamp A4 differs from the LED lamp 100 in that the LED lamp A4 includes a mount 40B in place of the mount 400 and further includes resins 50*a* and 50*b*. Since a configuration of the LED lamp A4 is otherwise similar to that of the LED lamp 100, a detailed description will not be repeated.

Figure 11:
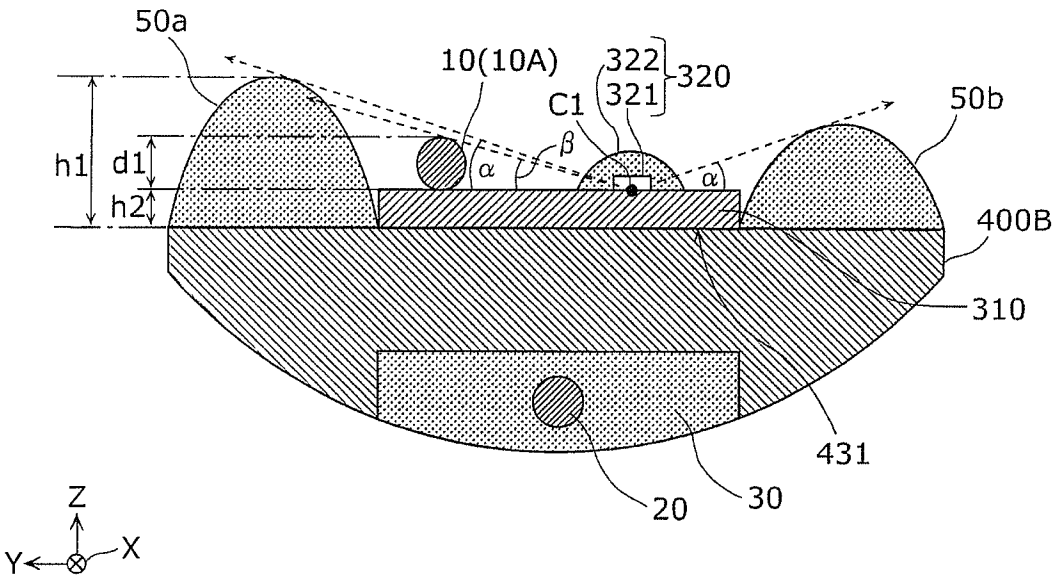
FIG. 11 is a cross-sectional view of a mount according to Modification 4 of the first embodiment.

FIG. 11 is a cross-sectional view of a mount 400B according to the fourth modification of the first embodiment. More specifically, FIG. 11 is a cross-sectional view of the mount 400B taken along line A-A' in FIG. 2 in a case where the mount 400 is replaced with the mount 400B.

The mount 400B has a shape in which a same shape (a shape illustrated in FIG. 11) continues from one end to another end of the mount 400B in a longitudinal direction.

An upper part of the mount 400B is a flat surface. The mount 400B has a same shape (a shape of the mount 400B in FIG. 11) from one end to the other end of the mount 400B in the longitudinal direction.

In other words, the LED lamp A4 includes the elongated mount 400B which is provided in the straight tube 200 and which extends in the tube axis direction.

In a similar manner to the first embodiment, a plurality of substrates 310 is arranged adjacent to one another in the tube axis direction on an upper part of the mount 400B.

The resins 50*a* and 50*b* are respectively formed at both end portions of the substrate 400B. In other words, the resin 50*a* is formed on an end portion of the mount 400B in a short-side direction. For example, the resins 50*a* and 50*b* are silicon resins.

The resin 50*a* has a same shape (a shape of the resin 50*a* in FIG. 11) from one end to the other end of the mount 400B in the longitudinal direction. The resin 50*b* has a same shape (a shape of the resin 50*b* in FIG. 11) from one end to the other end of the mount 400B in the longitudinal direction.

Among the resin 50*a*, a shape in the tube axis direction of an upper end portion (end portion) of a section where the resin 50*a* blocks light from the light emitting unit 320 is a linear shape. In addition, among the resin 50*b*, a shape in the tube axis direction of an upper end portion (end portion) of a section where the resin 50*b* blocks light from the light emitting unit 320 is a linear shape.

The light blocking unit B according to the fourth modification of the first embodiment is the resin 50*a*. In addition, in this case, h1 according to the fourth modification of the first embodiment is a height to an upper end of the resin 50*a* from an upper end of the mount 400B.

It should be noted that the light blocking unit A described earlier according to the fourth modification of the first embodiment is the same as the light blocking unit A according to the first embodiment. Therefore, d1 and h2 according to the fourth modification of the first embodiment are the same as d1 and h2 according to the first embodiment. Even in this case, Expressions 1 to 3 described earlier are satisfied.

Therefore, with the LED lamp A4 according to the fourth modification of the first embodiment, similar advantageous effects as the first embodiment are achieved. In other words, it is possible to prevent unappealing shadows from being created.

It should be noted that the resin 50*b* is preferably also formed so as to satisfy the definitions satisfied by the light blocking unit B according to the fourth modification of the first embodiment. In other words, as illustrated in FIG. 11, let us assume that a line connecting the light emission central position C1 and an upper end of a section which blocks light from the light emitting unit 320 among the resin 50*b* is a third line. In this case, a height and a shape of the resin 50*b* are defined so that an angle formed between the third line and the main surface of the substrate 310 is equal to $\alpha$.

In this case, a shadow illustrated in (c) in FIG. 7 is projected at a same height in a vicinity of both end portions of the mount 400 among the inner surface of the straight tube 200 in a similar manner to the first embodiment. Therefore, an aesthetic appearance of the LED lamp A4 during light emission can be improved.

It should be noted that when a glass tube is similarly used as the straight tube 200 in the fourth modification of the first embodiment, the light blocking unit A described earlier according to the fourth modification of the first embodiment is constituted by one or more lines 10 as electric members and the resin 31 which covers respective upper parts of the one or more lines 10.

[The Fifth Modification of the First Embodiment]

Next, an LED lamp (hereinafter, referred to as an LED lamp A5) according to a fifth modification of the first embodiment will be described.

By comparing the LED lamp A5 with the LED lamp 100, the LED lamp A5 differs from the LED lamp 100 in that the LED lamp A5 includes a single LED module 300A instead of the plurality of LED modules 300. Since a configuration of the LED lamp A5 is otherwise similar to that of the LED lamp 100, a detailed description will not be repeated.

A length of the LED module 300A in a longitudinal direction is the same as the length in the longitudinal direction of a single LED module 300 illustrated in FIGS. 4 and 5.

In addition, a length in the tube axis direction of the straight tube 200 in the LED lamp A5 is a length in the tube axis direction of the straight tube 200 in a case where the plurality of LED modules 300 illustrated in FIG. 4 is replaced with the single LED module 300A.

Furthermore, a length in the tube axis direction of the mount 400 is approximately the same as the length in the longitudinal direction of one substrate 310.

Figure 12:
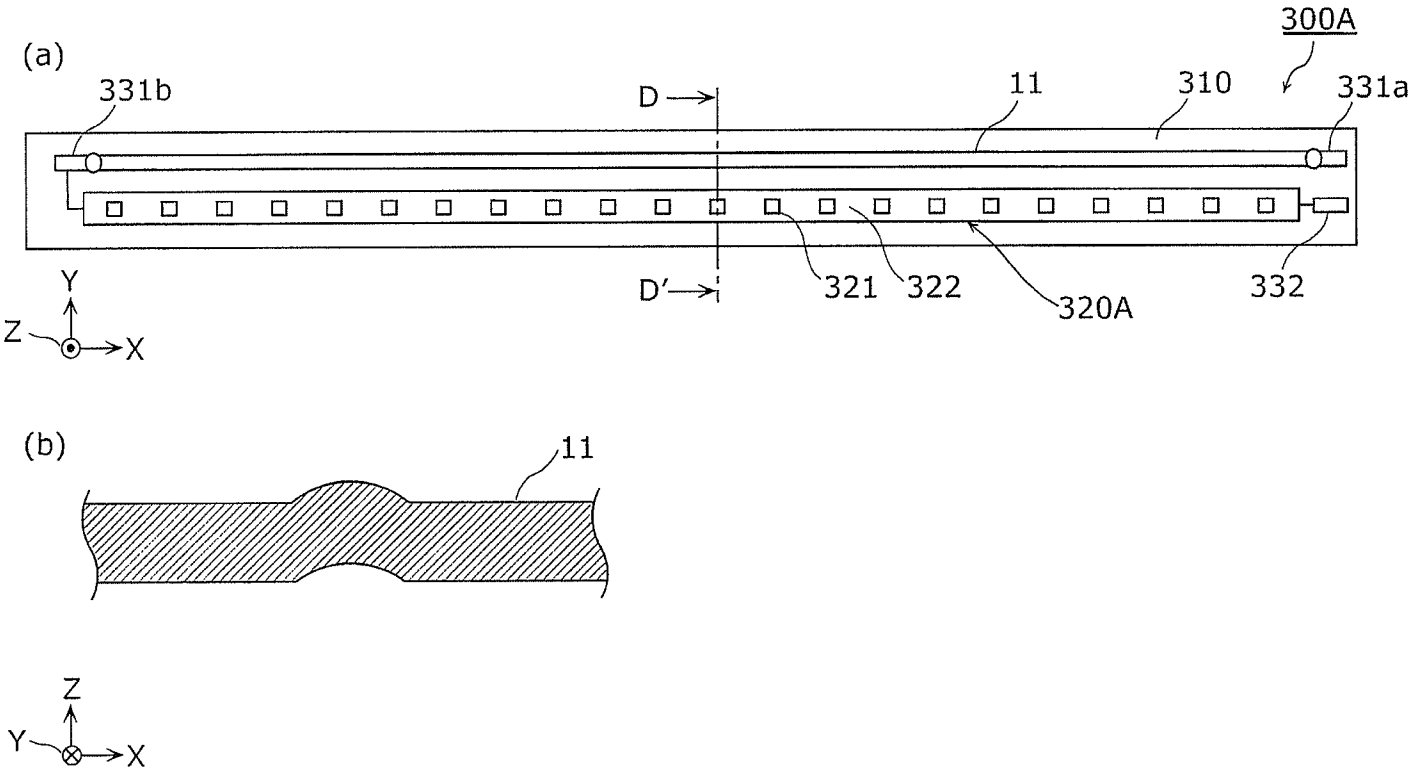
FIG. 12 is a diagram for describing a configuration of an LED module according to Modification 5 of the first embodiment.

FIG. 12 is a diagram for describing a configuration of an LED module 300A according to a fifth modification of the first embodiment.

(a) in FIG. 12 is an upper view of the LED module 300A according to the fifth modification of the first embodiment.

With reference to (a) in FIG. 12, by comparing the LED module 300A with the LED module 300 illustrated in FIG. 4 and (c) in FIG. 5, the LED module 300A differs from the LED module 300 in that the LED module 300A does not include the line 20, includes a light emitting unit 320A in place of the light emitting unit 320, includes electrodes 331*a*, 331*b*, and 332 in place of the electrodes 330*a* and 330*b*, and further includes a line 11. Since a configuration of the LED module 300A is otherwise similar to that of the LED module 300, a detailed description will not be repeated.

The electrodes 331*a*, 331*b*, and 332 are formed on a main surface of the substrate 310 of the LED module 300A.

The electrode 331*a* and the electrode 331*b* are electrically connected to each other by the line 11. The line 11 is arranged on the main surface of the substrate 310 in the tube axis direction. The line 11 is a wiring which is similar in configuration to the line 10.

Figure 13:
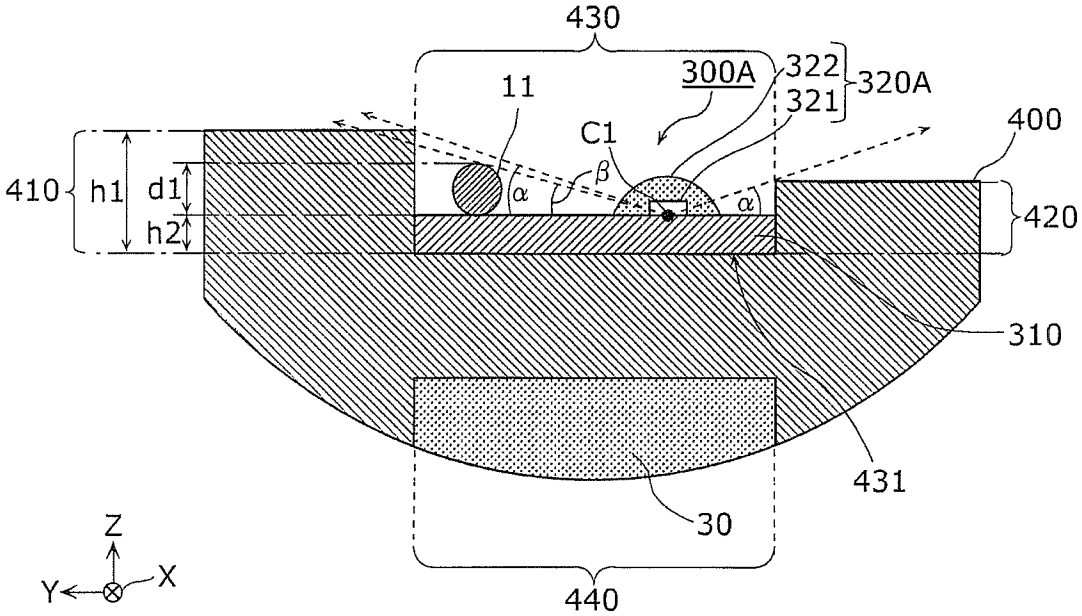
FIG. 13 is a cross-sectional view of the LED module according to Modification 5 of the first embodiment.

FIG. 13 is a cross-sectional view of the LED module 300A according to the fifth modification of the first embodiment. More specifically, FIG. 13 is a cross-sectional view of the LED module 300A taken along line D-D' in (a) in FIG. 12. Note that FIG. 13 also presents a cross-sectional view of the mount 400 corresponding to a section of line D-D' illustrated in FIG. 12.

With reference to (a) in FIGS. 12 and 13, by comparing the light emitting unit 320A with the light emitting unit 320 illustrated in FIG. 5, the light emitting unit 320A differs from the light emitting unit 320 in that the light emitting unit 320A is not formed to edges of both ends of the substrate 310 in the longitudinal direction. Since a configuration of the light emitting unit 320A is otherwise similar to that of the light emitting unit 320 illustrated in FIG. 5, a detailed description will not be repeated.

The substrate 310 is provided on the bottom surface 431 of the recessed portion 430 of the mount 400. The substrate 310 is provided in the straight tube 200, not illustrated. In other words, the light emitting unit 320A is provided in the straight tube 200 so as to extend in the tube axis direction.

The light emitting unit 320A is formed on the main surface of the substrate 310. The light emitting unit 320A has an elongated shape. In other words, the light emitting unit 320A is provided on the main surface of the substrate 310 so as to extend in the tube axis direction.

The light emitting unit 320A is constituted by a plurality of LEDs 321 and the sealing member 322 in a similar manner to the light emitting unit 320. The plurality of LEDs 321 included in the light emitting unit 320A is electrically connected in series by a wiring pattern, not illustrated, formed on the surface of the substrate 310. Hereinafter, the plurality of LEDs 321 included in the light emitting unit 320A will be collectively referred to as a LED group.

In (a) in FIG. 12, the LED 321 at a right end among the plurality of LEDs 321 constituting the LED group is electrically connected to the electrode 332. The LED 321 at a left end among the plurality of LEDs 321 constituting the LED group is electrically connected to the electrode 331*b*.

It should be noted that in the LED lamp A5, the line 20 is not provided in the recessed portion 440 (the adhesive 30). In the LED lamp A5, the line 11 corresponds to the line 20 described earlier. In the LED lamp 100, the line 11 is provided above the mount 400.

In the present embodiment, it is assumed that DC power is supplied from the base 201*a*, not illustrated.

The electrodes 331*a* and 332 are electrically connected to the base 201*a*, not illustrated, by two lines, not illustrated. In other words, DC power is supplied to the electrodes 331*a* and 332 by two lines, not illustrated. Accordingly, DC power can be supplied to all LEDs 321 in the light emitting unit 320A.

The line 11 will now be described.

(b) in FIG. 12 presents a cross-sectional view of the line 11. The line 11 is fixed to the main surface of the substrate 310 by an adhesive or the like at a plurality of locations on the substrate 310. However, in a section where an adhesive is not present, for example, a part of the line 11 bends as illustrated in (b) in FIG. 12. In other words, a shape in the tube axis direction of the upper end portion of the line 11 is a non-linear shape having a raised portion.

Hereinafter, a component which blocks a part of light proceeding in a direction perpendicular to the tube axis direction from the light emitting unit 320A will be referred to as a light blocking unit A. In the fifth modification of the first embodiment, the line 11 is the light blocking unit A. The line 11 is an electric member which is used by the light emitting unit 320A for emitting light. In other words, the light blocking unit A is also an electric member. The line 11 as an electric member is arranged on the main surface of the substrate 310.

It should be noted that the electric member is not limited to the line 11. For example, the electric member may alternatively be constituted by the line 11 and solder provided at the line 11.

Hereinafter, a component which blocks light not blocked by the light blocking unit A among light proceeding in a direction perpendicular to the tube axis direction from a light emitting unit will be referred to as a light blocking unit B. In this case, the light emitting unit is the light emitting unit 320A.

In this case, in a similar manner to the first embodiment, light which is not blocked by the light blocking unit A among light proceeding in a direction perpendicular to the tube axis direction from a light emitting unit is, for example, light which passes through a region (a region A) enclosed by a line parallel to the tube axis direction which is in contact with an uppermost part of a section which blocks light from a light emitting unit among the light blocking unit A and by the light blocking unit A.

In other words, the light blocking unit B at least blocks light which is not blocked by the light blocking unit A among light proceeding in a direction perpendicular to the tube axis direction from a light emitting unit and which is light passing through a region enclosed by a line parallel to the tube axis direction which is in contact with an uppermost part of a section which blocks light from a light emitting unit among the light blocking unit A and by the light blocking unit A.

In the fifth modification of the first embodiment, the raised portion 410 is the light blocking unit B.

In addition, hereinafter, a center position of a section from which the light emitting unit 320A emits light will be referred to as a light emission central position C1. The light emission central position C1 is a center position of an active layer of the LEDs 321 included in the light emitting unit 320A.

In this case, d1 according to the fifth modification of the first embodiment is a height to an upper end of the line 11 as the light blocking unit A from the bottom surface 431. It should be noted that h1 and h2 according to the fifth modification of the first embodiment are the same as h1 and h2 according to the first embodiment.

Even in this case, h1 is defined so that Expressions 1 to 2 described earlier are satisfied.

Expression 1 defines the height to an upper end of the light blocking unit B from the bottom surface 431 to be greater than the thickness of the substrate 310. Expression 2 defines the height of the upper end to the light blocking unit B from the bottom surface 431 to be greater than the height of an upper end of the electric member (light blocking unit A) from the bottom surface 431.

In a similar manner to the first embodiment, let us now assume that, as illustrated in FIG. 13, a line connecting the light emission central position C1 and an upper end of a section which blocks light from the light emitting unit 320A among the light blocking unit B (the raised portion 410) is a first line. In addition, an angle formed between the first line and the main surface of the substrate 310 is assumed to be α.

Let us also assume that a line connecting the light emission central position C1 and an upper end of a section which blocks light from the light emitting unit 320A among the light blocking unit A is a second line. In addition, an angle formed between the second line and the main surface of the substrate 310 is assumed to be β.

In this case, angles α and β are defined by Expression 3 described above.

Accordingly, in a similar manner to the first embodiment, an unappealing shadow which is created due to the line 11 blocking light from the light emitting unit 320A is not projected onto an inner surface of the straight tube 200 and a shadow of an upper end portion of the raised portion 410 as the light blocking unit B is projected.

Therefore, with the LED lamp A5 according to the fifth modification of the first embodiment, similar advantageous effects as the first embodiment are achieved. In other words, it is possible to prevent unappealing shadows from being created.

It should be noted that the raised portion 420 is preferably also formed so as to satisfy the definitions satisfied by the light blocking unit B according to the fifth modification of the first embodiment. In other words, as illustrated in FIG. 13, let us assume that a line connecting the light emission central position C1 and an upper end of a section which blocks light from the light emitting unit 320A among the raised portion 420 is a third line. In this case, a height and a shape of the raised portion 420 are defined so that an angle formed between the third line and the main surface of the substrate 310 is equal to α.

It should be noted that when a glass tube is similarly used as the straight tube 200 in the fifth modification of the first embodiment, the light blocking unit A described earlier according to the fifth modification of the first embodiment is constituted by the line 11 as an electric member and the resin 31 which covers an upper part of the line 11 in a similar manner to the first modification of the first embodiment.

In this case, the light blocking unit A is arranged on the main surface of the substrate 310. In addition, a height to the upper end of the light blocking unit B from the bottom surface 431 is greater than a height to an upper end of the resin which covers an upper part of the electric member from the bottom surface 431.

[The Sixth Modification of the First Embodiment]

Next, an LED lamp (hereinafter, referred to as an LED lamp A6) according to a sixth modification of the first embodiment will be described.

By comparing the LED lamp A6 with the LED lamp 100, the LED lamp A6 differs from the LED lamp 100 in that the LED lamp A6 includes a mount 400C in place of the mount 400. Since a configuration of the LED lamp A6 is otherwise similar to that of the LED lamp 100, a detailed description will not be repeated.

Figure 14:
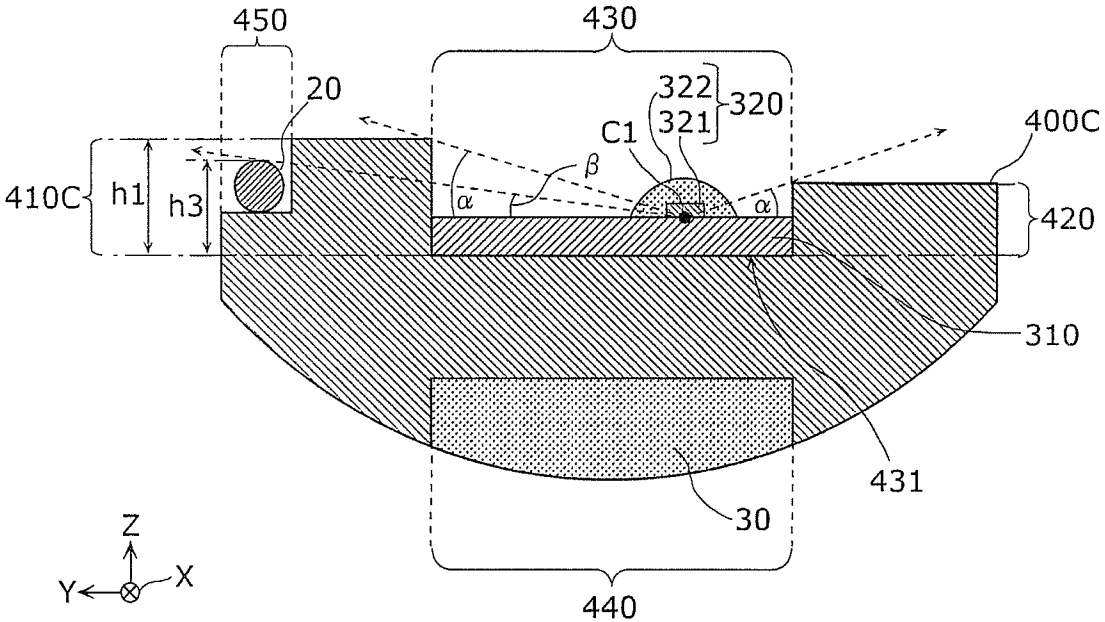
FIG. 14 is a cross-sectional view of a mount according to Modification 6 of the first embodiment.

FIG. 14 is a cross-sectional view of a mount 400C according to the sixth modification of the first embodiment. More specifically, FIG. 14 is a cross-sectional view of the mount 400C taken along line A-A' in FIG. 2 in a case where the mount 400 is replaced with the mount 400C.

The mount 400C has a shape in which a same shape (a shape illustrated in FIG. 14) continues from one end to another end of the mount 400C in a longitudinal direction.

By comparing the mount 400C with the mount 400, the mount 400C differs from the mount 400 in that the mount 400C includes a raised portion 410C in place of the raised portion 410. Since a configuration of the mount 400C is otherwise similar to that of the mount 400, a detailed description will not be repeated.

In the raised portion 410C, a shape in the tube axis direction of an upper end portion (end portion) of a section where the raised portion 410C blocks light from the light emitting unit 320 is a linear shape.

A groove portion 450 is formed on the mount 400C. The groove portion 450 has a shape in which a same shape (a shape illustrated in FIG. 14) continues from one end to the other end of the mount 400C in the longitudinal direction.

The line 20 is arranged so as to extend in the tube axis direction (X direction) in the groove portion 450. The line 20 is fixed to the groove portion 450 by an adhesive or the like at a plurality of locations in the groove portion 450. Therefore, as illustrated in (b) in FIG. 12, a part of the line 11 bends.

It should be noted that, in the LED lamp A6, the line 20 is arranged at a position which is higher than the substrate 310 instead of in the recessed portion 440 of the mount 400C.

The line 20 is an electric member which is used by the light emitting unit for emitting light.

It should be noted that the electric member is not limited to the line 20. For example, the electric member may alternatively be constituted by the line 20 and solder provided at the line 20.

Hereinafter, a component which blocks light proceeding toward the electric member (line 20) and which is a part of light proceeding in a direction perpendicular to the tube axis direction from the light emitting unit 320 will be referred to as a light blocking unit C. In other words, the raised portion 410C according to the sixth modification of the first embodiment is the light blocking unit C.

In this case, a height to an upper end of the light blocking unit C (the raised portion 410C) from the bottom surface 431 of the recessed portion 430 is assumed to be h1. In addition, a height to an upper end of the line 20 from the bottom surface 431 of the recessed portion 430 is assumed to be h3.

In this case, h1 is defined by Expression 5 below as a relational equation.

$$h>h3 \qquad \text{Expression 5}$$

Expression 5 defines the height to an upper end of the light blocking unit C from the bottom surface 431 to be greater than the height to an upper end of the line 20 as an electric member from the bottom surface 431.

Let us now assume that, as illustrated in FIG. 14, a line connecting the light emission central position C1 and an upper end of a section which blocks light from the light emitting unit 320 in the light blocking unit C (the raised portion 410C) is a first line. In addition, an angle formed between the first line and the main surface of the substrate 310 is assumed to be α.

Furthermore, a line connecting the light emission central position C1 and the upper end of the electric member (the line 20) is assumed to be a second line. Moreover, an angle formed between the second line and the main surface of the substrate 310 is assumed to be β.

In this case, angles α and β are defined by Expression 3 described above.

Here, in the raised portion 410C as the light blocking unit C, a shape in the tube axis direction of an upper end portion (end portion) of a section where the raised portion 410C blocks light is a linear shape.

Accordingly, in a similar manner to the first embodiment, an unappealing shadow which is created due to the line 20 blocking light from the light emitting unit 320 is not projected onto an inner surface of the straight tube 200 and a shadow of an upper end portion of the raised portion 410C as the light blocking unit C is projected.

Therefore, with the LED lamp A6 according to the sixth modification of the first embodiment, similar advantageous effects as the first embodiment are achieved. In other words, it is possible to prevent unappealing shadows from being created.

Note that the raised portion 420 is formed as described in the first embodiment.

[The Second Embodiment]

Figure 15:
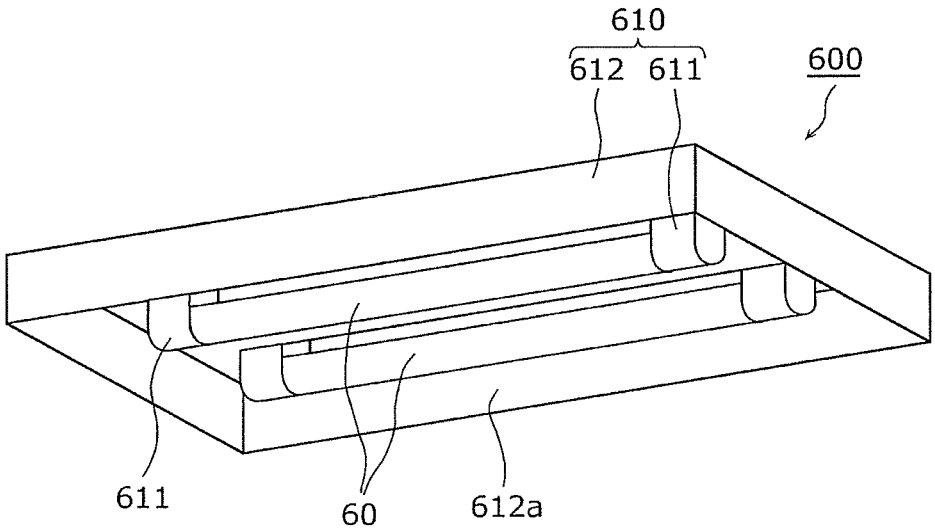
FIG. 15 is a perspective view illustrating a configuration of a lighting apparatus according to Embodiment 2.

FIG. 15 is a cross-sectional view of a lighting appratus 600 according to a second embodiment.

A lighting apparatus 600 includes an LED lamp 60 and lighting equipment 610.

The lighting equipment 610 includes a pair of sockets 611, a fixture body 612, and a not illustrated circuit box (outside of drawing).

The pair of sockets 611 is electrically connected to the LED lamp 60. The pair of sockets 611 hold the LED lamp 60. The sockets 611 are attached to the fixture body 612.

An inner surface 612*a* of the fixture body 612 is a reflecting surface which reflects, in a predetermined direction (for example, downward), light emitted from the LED lamp 60.

The circuit box internally houses a lighting circuit which supplies power to the LED lamp 60 when a switch (outside of drawing) is turned on and which does not supply power when the switch is turned off. For example, a rectifier circuit constituted by a diode bridge using four Zener diodes is used as the lighting circuit.

The lighting equipment 610 is mounted to a ceiling or the like via a fixture.

The LED lamp 60 is any of the LED lamps 100, A1, A2, A3, A4, A5, and A6 described above.

[Other Modifications]

Next, a description will be given regarding modifications of LED lamps according to embodiments and modifications of the embodiments of the present invention described above. It should be noted that the respective modifications below can also be applied to a lighting apparatus according to the second embodiment.

[Modification A]

An LED lamp 100X according to modification A of the present embodiment will now be described with reference to (a) in FIG. 16 and (b) in FIG. 16.

Figure 16:
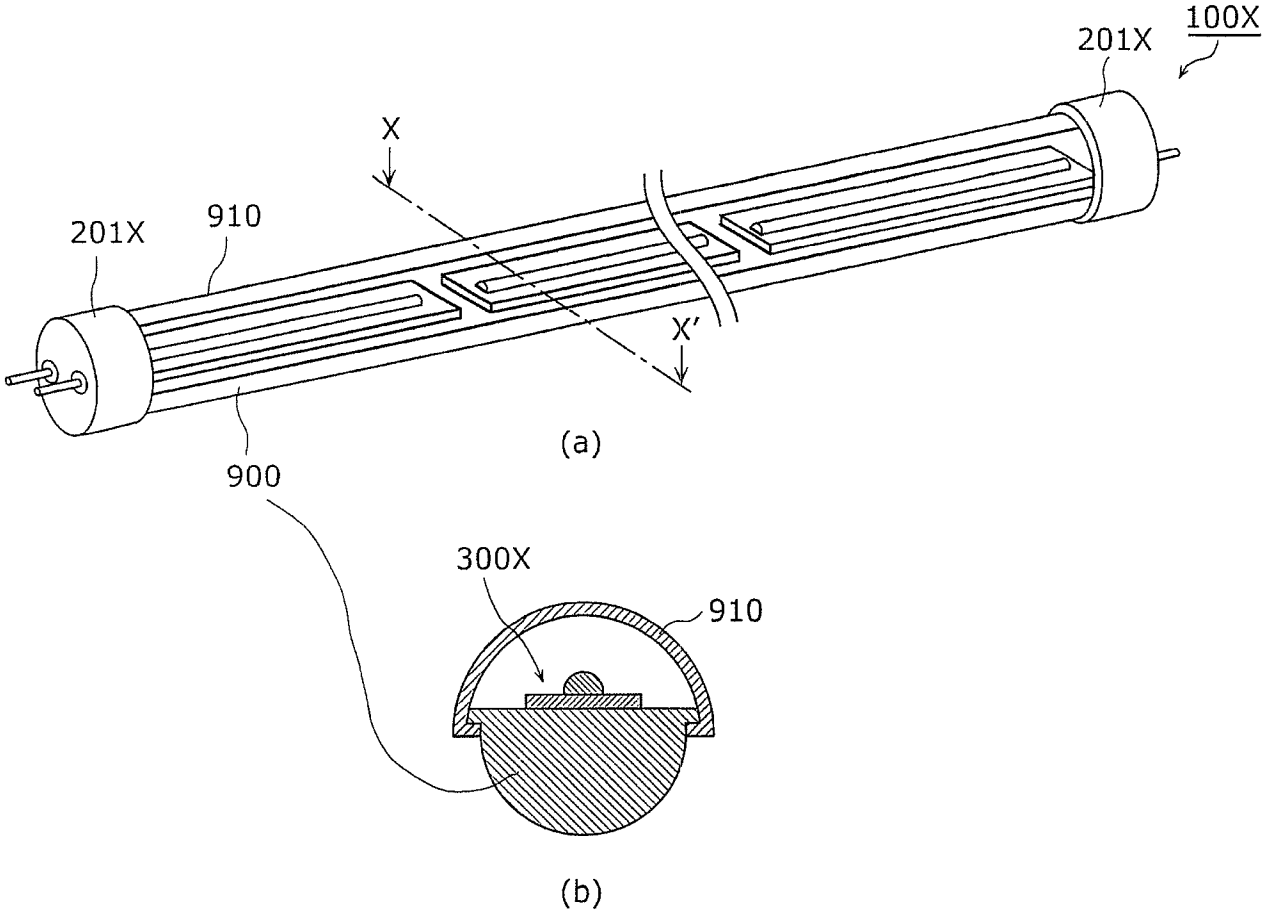
FIG. 16 is a diagram illustrating an LED lamp according to Modification A.

(a) in FIG. 16 is a cross-sectional view of the LED lamp 100X according to the modification A. In addition, (b) in FIG. 16 is a cross-sectional view of the LED lamp 100X taken along line X-X' in (a) in FIG. 16 according to the modification A.

As illustrated in (a) in FIG. 16 and (b) in FIG. 16, the LED lamp 100X according to the present modification A is constituted by a metallic case 900 made of metal such as aluminum and a cover 910 attached to the metallic case 900.

The metallic case 900 has an approximately semicircular column shape. An LED module 300X is mounted to a surface covered by the cover 910 among the metallic case 900.

The LED module 300X is any of the LED modules 300 and 300A described earlier.

In addition, a cylindrical surface portion of the metallic case 900 is exposed to outside and heat generated by the LED module 300X is dissipated from the exposed portion.

The cover 910 has an approximately semi-cylindrical shape and is made of a synthetic resin such as plastic.

It should be noted that a base 201X with a bottomed cylindrical shape is attached to both end portions of the cover 910 and the metallic case 900.

[Modification B]

In the LED lamps according to the embodiments described above, one end of the mount 400 in the longitudinal direction may be fixed to the inner surface of the straight tube 200 by a substrate fixing member provided between the base 201*a* and an end portion of the straight tube 200.

Figure 17:
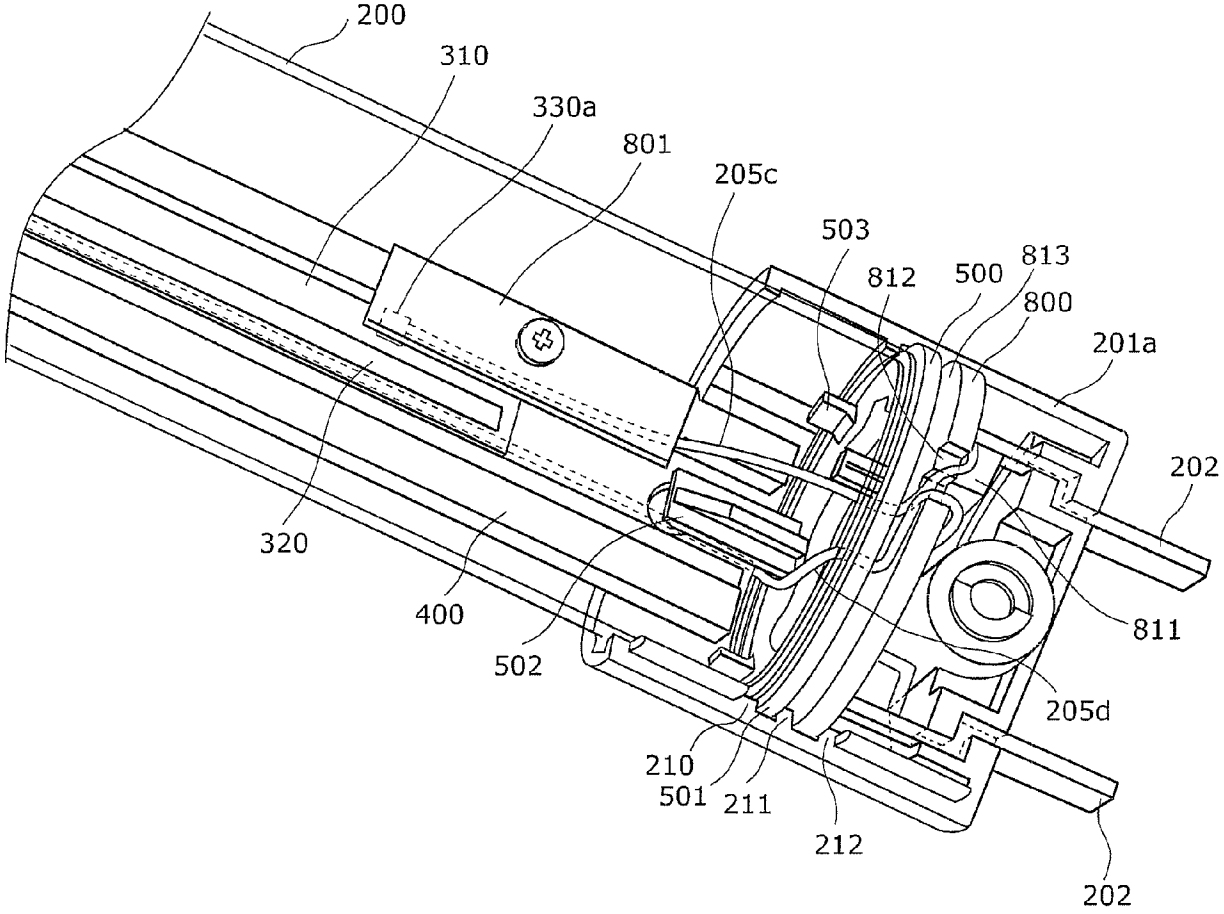
FIG. 17 is a perspective view illustrating, in detail, an internal configuration of one end of an LED lamp according to Modification B.
Figure 18:
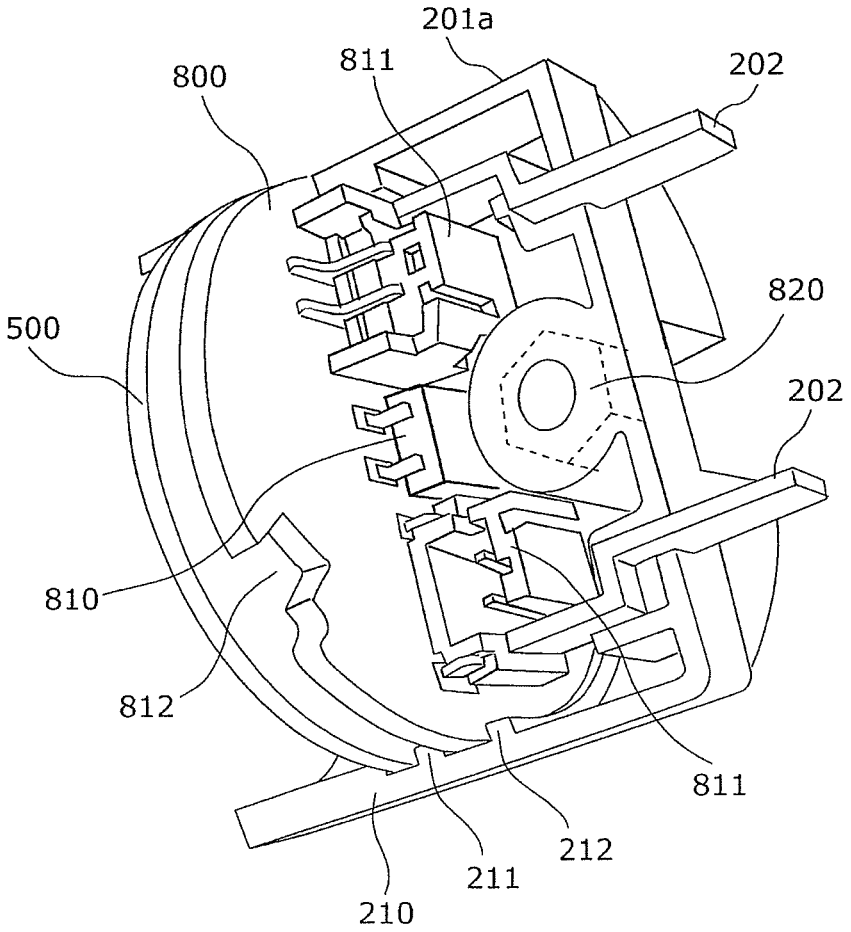
FIG. 18 is a perspective view illustrating, in detail, an internal configuration of a base of one end of the LED lamp according to Modification B.

FIGS. 17 and 18 are perspective views illustrating a state where a substrate fixing member 500 is attached to the straight tube 200. Note that FIG. 17 illustrates an interior of the LED lamp as though the straight tube 200 is transparent. In FIG. 18, the straight tube 200 and inner members of the straight tube 200 are omitted.

The substrate fixing member 500 is a member made of a flexible material and is constituted by a flat plate-like body 501 which covers an opening at an end portion of the straight tube 200, and a fixing portion 502 and three locking portions 503 provided so as to protrude from the body 501 toward the inside of the straight tube 200.

The substrate fixing member 500 is attached to the straight tube 200 by pushing the fixing portion 502 and the three locking portions 503 into the straight tube 200 so that the substrate fixing member 500 fits with an end portion of the straight tube 200.

A through hole is provided on the body 501 and lines 205*c* and 205*d* from the pair of base pins 202 of the base 201*a* are passed through the through hole. The lines 205*c* and 205*d* respectively correspond to the lines 21 and 20.

The lines 205*c* and 205*d* are electrically connected to the LED 321 of the LED module 300.

The body 501 is sandwiched between two raised portions 210 and 211 provided on an inner wall of the base 201*a*. In this case, a substrate 800 on which a lighting circuit is formed is provided inside the base 201*a* provided at one end of the straight tube 200. The raised portions 211 and 212 provided on the inner wall of the base 201*a* sandwich the substrate 800.

The lighting circuit provided on the substrate 800 is constituted by a rectifier circuit element 810 such as a diode bridge circuit and an input/output unit 811 which is electrically connected to the rectifier circuit element 810 by a line provided on the substrate 800.

Low-height components such as the rectifier circuit element 810 are arranged in a space in a vicinity of a screw portion 820 on the substrate 800 (a space between a screw portion (screw hole portion) 820 into which a screw is inserted for integrating the base 201*a*, and the substrate 800).

The input/output unit 811 is electrically connected to the base pin 202 by welding, soldering, plugging, and the like and, at the same time, electrically connected to the lines 205*c* and 205*d* which are electrically connected to the LED 321 of the LED module 300. The lines 205*c* and 205*d* are passed through a notched portion 812 provided on the substrate 800 as well as through a gap 813 between the substrate 800 and the body 501 of the substrate fixing member 500, and is guided to the inside of the straight tube 200 from the substrate 800.

Provided on the mount 400 is a resin component 801 which fixes the LED module 300 (the substrate 310) to the mount 400 by being screwed and fixed to the mount 400. A part of the line 205*c* is sandwiched between the substrate 310 and the resin component 801, and one end of the line 205*c* is bonded to the electrode 330*a* on the substrate 310.

On the other hand, the line 205*d* passes through a gap between the mount 400 and the substrate fixing member 500 and reaches a recessed portion which is provided on a surface of the mount 400 opposing the straight tube 200 and which runs in the tube axis direction, passes through inside the recessed portion, and is electrically connected to the LED module 300 provided at the other end of the straight tube 200.

The base 201*a* provided at one end of the straight tube 200 is constructed such that the base 201*a* can be disassembled into halves.

Figure 19:
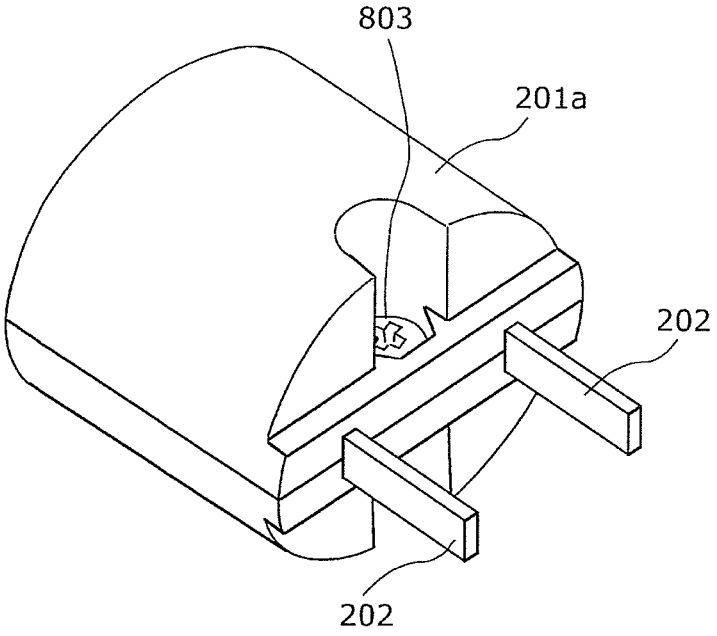
FIG. 19 is a perspective view illustrating, in detail, the base integrally provided on one end of a straight tube according to Modification B.

After the substrate 800 and the substrate fixing member 500 are arranged in the base 201*a* in a disassembled state as illustrated in FIGS. 17 and 18, the base 201*a* is integrated by a screw 803 as illustrated in the perspective view in FIG. 19.

Figure 20:
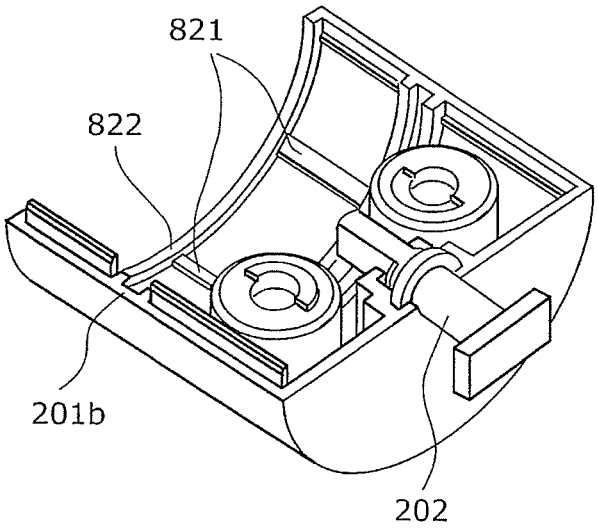
FIG. 20 is a perspective view of a disassembled base provided on the other end of the straight tube according to Modification B.
Figure 21:
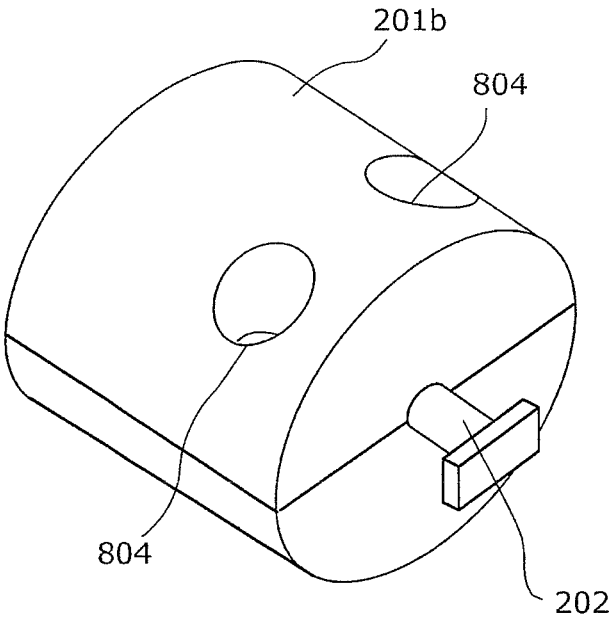
FIG. 21 is a perspective view illustrating the base integrally provided on the other end of the straight tube according to Modification B.

In a similar manner, as illustrated in FIGS. 20 and 21, the base 201*b* provided on the other end of the straight tube 200 is also constructed such that the base 201*b* can be disassembled into halves. Only one base pin 202 is provided on the base 201*b*. Therefore, two screws 804 can be arranged so as to sandwich the base pin 202 and the base 201*b* can be integrated by the two screws 804.

A turn-preventing rib 821 and a retaining rib 822 are provided on an inner surface of the base 201*b*. By meshing with an adhesive which attaches the base 201*b* to the straight tube 200, the turn-preventing rib 821 prevents the base 201*b* and the straight tube 200 from slipping when a torque around an axis is applied to the LED lamp.

On the other hand, by meshing with the adhesive which attaches the base 201*b* to the straight tube 200, the retaining rib 822 prevents the base 201*b* from detaching from the straight tube 200 when a force in an axial direction is applied to the LED lamp. It should be noted that this single base pin 202 is provided to enable grounding and attachment to lighting equipment.

[Modification C]

With the LED lamps 100 according to the embodiments described above, COB (Chip On Board) type LED modules in which LEDs themselves (bare chips) are directly mounted on a substrate are adopted as the LED modules 300 and 300A.

However, the LED module 300 may be a package type LED module in which LED chips are mounted in a cavity molded with resin or the like and an inside of the cavity is sealed with a phosphor-containing resin or, in other words, a surface mount device (SMD) type LED module.

Such an SMD type LED module 300B according to a modification C of the present invention will be described below.

Figure 22:
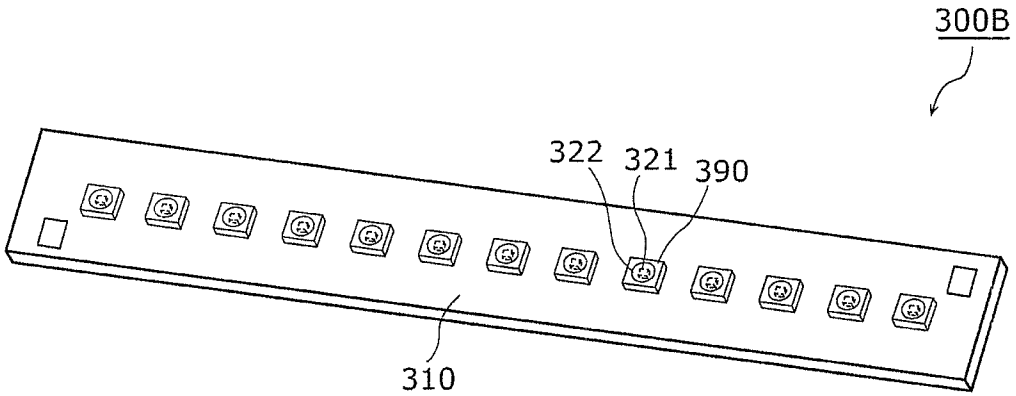
FIG. 22 is a perspective view of an LED module according to Modification C.

FIG. 22 is a perspective view of the LED module 300B according to Modification C.

As illustrated in FIG. 22, in the LED module 300B, a plurality of packages 390 is linearly mounted on a surface of the substrate 310 in a single row in a longitudinal direction (a direction parallel to the tube axis direction) of the substrate 310 by a die attaching agent or the like.

The package 390 is made of resin or the like and the LED 321 is mounted in a cavity of the package 390. In addition, the mounted LED 321 is covered by the sealing member 322. The plurality of packages 390 is electrically connected in series to one another by a wiring pattern, a wire, and the like.

The LED lamp and the lighting apparatus according to the present invention have been described above based on each of the embodiments. However, the present invention is not limited to these embodiments. Other forms in which various modifications apparent to those skilled in the art are applied to the embodiments are also included within the scope of the present invention, unless such changes and modifications depart from the scope of the present invention. In addition, structural elements in plural embodiments may be arbitrarily combined, unless such combination departs from the scope of the present invention.

For example, in the embodiments described above, the plurality of LEDs 321 on the substrate 310 of the LED module 300 is collectively sealed by a common sealing member 322. However, each of the plurality of LEDs 321 may alternatively be individually sealed by different sealing members 322.

In addition, while the lighting apparatus 600 includes a lighting circuit in the embodiments described above, the LED lamp 100 may alternatively include a lighting circuit inside the base 201*a*. In other words, a lighting circuit may be provided in one of the bases 201*a* and 201*b* or lighting circuits may be provided in both of the bases 201*a* and 201*b*.

In addition, although an LED is used as an example of a semiconductor light-emitting element in the above-described exemplary embodiments, it is also possible to use another semiconductor light-emitting element such as a semiconductor laser and an organic EL (Electro Luminescence).

It is to be understood that the embodiments disclosed above are intended not for the purpose of limitation but for exemplification only in all respects. The scope of this invention is indicated not by the aforementioned description but by the Claims, and it is intended that various changes and modifications within the same or equivalent meaning and scope of the Claims may be included.

INDUSTRIAL APPLICABILITY

The present invention can be utilized in alternative lighting to straight tube fluorescent lamps and particularly in LED lamps, lighting apparatuses, and the like.

REFERENCE SIGNS LIST

10, 11, 20, 21 line
10A line unit
30 adhesive
31 resin
50*a*, 50*b* resin
60, 100, 100X LED lamp
200 straight tube
201*a*, 201*b* base
300, 300A, 300B LED module
310 substrate
320, 320A light emitting unit
330*a*, 330*b*, 331*a*, 331*b*, 332 electrode
400, 400A, 400B, 400C mount
410, 410A, 410C, 420, 420A raised portion
430, 440 recessed portion
450 groove portion
500 substrate fixing member
600 lighting apparatus

The invention claimed is:

1. A lamp, comprising:

a straight tube;

a light emitter disposed in the straight tube and extending in a tube axis direction;

a first light blocker configured to block a part of light proceeding from the light emitter in a direction perpendicular to the tube axis direction; and a second light blocker configured to block the light proceeding from the light emitter in the direction perpendicular to the tube axis direction that is not blocked by the first light blocker, wherein the second light blocker has an end portion having a linear shape in the tube axis direction, the end portion being an end portion of a section of the second light blocker that blocks light, and the first light blocker and the second light blocker are disposed in the straight tube.

2. A lamp, comprising:

a straight tube;

a light emitter disposed in the straight tube and extending in a tube axis direction;

a first light blocker configured to block a part of light proceeding from the light emitter in a direction perpendicular to the tube axis direction;

a second light blocker configured to block the light proceeding from the light emitter in the direction perpendicular to the tube axis direction that is not blocked by the first light blocker; and a mount disposed in the straight tube and extending in the tube axis direction, wherein the second light blocker has an end portion having a linear shape in the tube axis direction, the end portion being an end portion of a section of the second light blocker that blocks light.

3. The lamp according to claim 2, wherein the mount has a recessed portion which extends in the tube axis direction, the lamp further comprises a substrate which is disposed on a bottom surface of the recessed portion of the mount and has an elongated shape extending in the tube axis direction, and the light emitter is disposed on a main surface of the substrate to extend in the tube axis direction.

4. The lamp according to claim 3, wherein the second light blocker is a part of the mount.

5. The lamp according to claim 3, wherein the second light blocker includes a part of the mount and a fixing portion disposed to cover an upper portion of the part of the mount, and the fixing portion is in contact with the main surface of the substrate to fix the substrate to the mount.

6. The lamp according to claim 3, wherein a height from the bottom surface to an upper end of the second light blocker is greater than a thickness of the substrate.

7. The lamp according to claim 3, further comprising a plurality of the substrates and a plurality of the light emitters, wherein the substrates are arranged adjacent to one another in the tube axis direction, the light emitters are disposed on the main surfaces of their respective substrates to be adjacent to one another in the tube axis direction, and an electric member is disposed in a vicinity of a boundary between adjacent ones of the light emitters, the electric member electrically connecting the adjacent ones of the light emitters.

8. The lamp according to claim 7, wherein the first light blocker includes one or more of the electric members arranged in the tube axis direction.

9. The lamp according to claim 7, wherein the straight tube is a glass tube, and the first light blocker includes the one or more of the electric members and a resin which covers an upper portion of each of the electric members.

10. The lamp according to claim 3, wherein the first light blocker is disposed on the main surface of the substrates adjacent to one another in the tube axis direction, and a height from the bottom surface to an upper end of the second light blocker is greater than a height from the bottom surface to an upper end of the first light blocker.

11. The lamp according to claim 3, wherein when: a line connecting (i) a light emission central position which is a center position of a section from which the light emitter emits light and (ii) an upper end of the section of the second light blocker that blocks light from the light emitter is a first line, an angle formed between the first line and the main surface of the substrate is $\alpha$;

a line connecting the light emission central position and an upper end of a section of the first light blocker that blocks light from the light emitter is a second line; and an angle formed between the second line and the main surface of the substrate is $\beta$, $\alpha$ and $\beta$ is defined by a relational equation of $\alpha>\beta$.

12. The lamp according to claim 3, wherein the first light blocker is an electric member which is used to cause the light emitter to emit light, the electric member is disposed on the main surface of the substrate, and a height from the bottom surface to an upper end of the second light blocker is greater than a height from the bottom surface to an upper end of the electric member.

13. The lamp according to claim 3, wherein the straight tube is a glass tube, the first light blocker includes:

an electric member which is used to cause the light emitter to emit light; and a resin which covers an upper portion of the electric member, the first light blocker is disposed on the main surface of the substrate, and a height from the bottom surface to an upper end of the second light blocker is greater than a height from the bottom surface to an upper end of the resin which covers the upper portion of the electric member.

14. The lamp according to claim 12, wherein when: a line connecting (i) a light emission central position which is a center position of a section from which the light emitter emits light and (ii) an upper end of the section of the second light blocker that blocks light from the light emitter is a first line, an angle formed between the first line and the main surface of the substrate is $\alpha$;

a line connecting the light emission central position and an upper end of a section of the first light blocker that blocks light from the light emitter is a second line; and an angle formed between the second line and the main surface of the substrate is $\beta$, $\alpha$ and $\beta$ is defined by a relational equation of $\alpha>\beta$.

15. The lamp according to claim 2, wherein the second light blocker includes a reflecting surface formed in a section which receives light from the light emitter, the reflecting surface reflects light from the light emitter to above the mount.

16. The lamp according to claim 1, further comprising a mount which is disposed in the straight tube and has an elongated shape extending in the tube axis direction, wherein the second light blocker is formed on an end portion of the mount in a short-side direction.

17. A lighting apparatus comprising the lamp according to claim 1.

18. A lamp, comprising:

a straight tube;

a light emitter disposed in the straight tube and extending in a tube axis direction;

a first light blocker configured to block a part of light proceeding from the light emitter in a direction perpendicular to the tube axis direction; and a second light blocker configured to block the light proceeding from the light emitter in the direction perpendicular to the tube axis direction that is not blocked by the first light blocker, wherein the second light blocker has an end portion having a linear shape in the tube axis direction, the end portion being an end portion of a section of the second light blocker that blocks light, and a shape, in a tube axis direction, of an end portion of a section where the first light blocker blocks light is a shape with a raised portion.

* * * * *